US011352577B2

(12) United States Patent
Woodchick et al.

(10) Patent No.: US 11,352,577 B2
(45) Date of Patent: Jun. 7, 2022

(54) LOW SULFUR FUEL OIL BLENDS FOR PARAFFINIC RESID STABILITY AND ASSOCIATED METHODS

(71) Applicant: MARATHON PETROLEUM COMPANY LP, Findlay, OH (US)

(72) Inventors: Matthew T. Woodchick, Findlay, OH (US); V. Elijah Mullins, Findlay, OH (US); Peg Broughton, Findlay, OH (US)

(73) Assignee: MARATHON PETROLEUM COMPANY LP, Findlay, OH (US)

( * ) Notice: Subject to any disclaimer, the term of this patent is extended or adjusted under 35 U.S.C. 154(b) by 0 days.

(21) Appl. No.: 17/249,079

(22) Filed: Feb. 19, 2021

(65) Prior Publication Data

US 2021/0253965 A1 Aug. 19, 2021

Related U.S. Application Data

(60) Provisional application No. 63/199,188, filed on Dec. 11, 2020, provisional application No. 62/978,798, filed on Feb. 19, 2020.

(51) Int. Cl.
*C10L 1/06* (2006.01)
*C10L 1/04* (2006.01)
(Continued)

(52) U.S. Cl.
CPC ..... *C10L 1/04* (2013.01); *C10G 11/18* (2013.01); *C10G 69/04* (2013.01); *C10L 1/06* (2013.01);
(Continued)

(58) Field of Classification Search
CPC ..... C10G 11/18; C10G 2300/107; C10G 2300/1077; C10G 2300/202;
(Continued)

(56) References Cited

U.S. PATENT DOCUMENTS 5,997,723 A 12/1999 Wiehe et al.
6,454,935 B1 9/2002 Lesieur et al.
(Continued)

FOREIGN PATENT DOCUMENTS

CN 201940168 8/2011
CN 102120138 12/2012
(Continued)

OTHER PUBLICATIONS

Lerh, Jeslyn et al., Feature: IMO 2020 draws more participants into Singapore's bunkering pool, Oil | Shipping, Sep. 3, 2019, Singapore, https://www.spglobal.com/platts/en/market-insights/latest-news/oil/090319-feature-imo-2020-draws-more-participants-into-singapores-bunkering-pool.

(Continued)

*Primary Examiner* — Ellen M McAvoy
*Assistant Examiner* — Chantel L Graham
(74) *Attorney, Agent, or Firm* — Womble Bond Dickinson (US) LLP

(57) ABSTRACT

Low sulfur fuel oil blend compositions and methods of making such blend compositions to increase the stability and compatibility of LSFO blends having paraffinic resids that are blended with distillates and/or cracked stocks of higher asphaltenes and/or aromatics content. In one or more embodiments, distillates and/or cracked stocks that incrementally reduce the initial aromaticity of the distillate or cracked stock with the highest aromaticity are sequentially blended prior to resid addition. Such incremental reduction and sequential blending have been found to provide a resulting low sulfur fuel oil blend that is both compatible and stable.

20 Claims, 6 Drawing Sheets

(51) Int. Cl.

| | |
|---|---|
| ***C10L 10/00*** | (2006.01) |
| ***C10G 69/04*** | (2006.01) |
| ***C10L 1/08*** | (2006.01) |
| ***C10G 11/18*** | (2006.01) |

(52) U.S. Cl.

CPC ..... *C10L 1/08* (2013.01); *C10L 10/00* (2013.01); *C10G 2300/107* (2013.01); *C10G 2300/1077* (2013.01); *C10G 2300/202* (2013.01); *C10G 2300/205* (2013.01); *C10G 2300/206* (2013.01); *C10G 2300/207* (2013.01); *C10G 2300/302* (2013.01); *C10G 2300/304* (2013.01); *C10G 2300/308* (2013.01); *C10G 2400/04* (2013.01); *C10L 2200/0263* (2013.01); *C10L 2200/0438* (2013.01); *C10L 2200/0446* (2013.01); *C10L 2200/0461* (2013.01); *C10L 2230/14* (2013.01); *C10L 2270/026* (2013.01); *C10L 2290/24* (2013.01); *C10L 2290/46* (2013.01); *C10L 2290/543* (2013.01); *C10L 2290/547* (2013.01)

(58) Field of Classification Search

CPC ..... C10G 2300/205; C10G 2300/206; C10G 2300/207; C10G 2300/302; C10G 2300/304; C10G 2300/308; C10G 2400/04; C10G 69/04; C10L 10/00; C10L 1/04; C10L 1/06; C10L 1/08; C10L 2200/0263; C10L 2200/0438; C10L 2200/0446; C10L 2200/0461; C10L 2230/14; C10L 2270/026; C10L 2290/24; C10L 2290/46; C10L 2290/543; C10L 2290/547

See application file for complete search history.

(56) References Cited

U.S. PATENT DOCUMENTS

| | | | | |
|---|---|---|---|---|
| 7,228,250 | B2 | 6/2007 | Naiman et al. | |
| 7,244,350 | B2 | 7/2007 | Kar et al. | |
| 8,029,662 | B2 | 10/2011 | Varma et al. | |
| 8,038,774 | B2 | 10/2011 | Peng | |
| 8,193,401 | B2 | 6/2012 | McGehee et al. | |
| 8,524,180 | B2 | 9/2013 | Canari et al. | |
| 8,916,041 | B2 | 12/2014 | Van Den Berg et al. | |
| 8,987,537 | B1 * | 3/2015 | Droubi | C10L 1/04 585/14 |
| 8,999,011 | B2 | 4/2015 | Stern et al. | |
| 9,057,035 | B1 | 6/2015 | Kraus et al. | |
| 9,109,176 | B2 | 8/2015 | Stern et al. | |
| 9,216,376 | B2 | 12/2015 | Liu et al. | |
| 9,272,241 | B2 | 3/2016 | Konigsson | |
| 9,289,715 | B2 | 3/2016 | Hoy-Petersen et al. | |
| 9,393,520 | B2 | 7/2016 | Gomez | |
| 9,410,102 | B2 | 8/2016 | Eaton et al. | |
| 9,458,396 | B2 | 10/2016 | Weiss et al. | |
| 9,487,718 | B2 | 11/2016 | Kraus et al. | |
| 9,499,758 | B2 | 11/2016 | Droubi et al. | |
| 9,624,448 | B2 | 4/2017 | Joo et al. | |
| 9,650,580 | B2 | 5/2017 | Merdrignac et al. | |
| 9,757,686 | B2 | 9/2017 | Peng | |
| 9,803,152 | B2 | 10/2017 | Kar et al. | |
| 9,834,731 | B2 | 12/2017 | Weiss et al. | |
| 9,840,674 | B2 | 12/2017 | Weiss et al. | |
| 9,873,080 | B2 | 1/2018 | Richardson | |
| 9,878,300 | B2 | 1/2018 | Norling | |
| 9,895,649 | B2 | 2/2018 | Brown et al. | |
| 9,896,630 | B2 | 2/2018 | Weiss et al. | |
| 9,914,094 | B2 | 3/2018 | Jenkins et al. | |
| 9,920,270 | B2 | 3/2018 | Robinson et al. | |
| 10,047,299 | B2 | 8/2018 | Rubin-Pitel et al. | |
| 10,099,175 | B2 | 10/2018 | Takahashi et al. | |
| 10,150,078 | B2 | 12/2018 | Komatsu et al. | |
| 10,266,779 | B2 | 4/2019 | Weiss et al. | |
| 10,308,884 | B2 | 6/2019 | Klussman | |
| 10,316,263 | B2 | 6/2019 | Rubin-Pitel et al. | |
| 10,443,006 | B1 | 10/2019 | Fruchey et al. | |
| 10,457,881 | B2 | 10/2019 | Droubi et al. | |
| 10,494,579 | B2 | 12/2019 | Wrigley et al. | |
| 10,501,699 | B2 | 12/2019 | Robinson et al. | |
| 10,533,141 | B2 | 1/2020 | Moore et al. | |
| 10,563,132 | B2 | 2/2020 | Moore et al. | |
| 10,563,133 | B2 | 2/2020 | Moore et al. | |
| 10,577,551 | B2 | 3/2020 | Kraus et al. | |
| 10,584,287 | B2 | 3/2020 | Klussman et al. | |
| 10,604,709 | B2 | 3/2020 | Moore et al. | |
| 10,655,074 | B2 | 5/2020 | Moore et al. | |
| 10,836,966 | B2 | 11/2020 | Moore et al. | |
| 10,876,053 | B2 | 12/2020 | Klussman et al. | |
| 10,954,456 | B2 | 3/2021 | Moore et al. | |
| 10,961,468 | B2 | 3/2021 | Moore et al. | |
| 11,021,662 | B2 | 6/2021 | Moore et al. | |
| 11,136,513 | B2 | 10/2021 | Moore et al. | |
| 11,203,722 | B2 | 12/2021 | Moore et al. | |
| 2004/0040201 | A1 | 3/2004 | Roos et al. | |
| 2004/0121472 | A1 | 6/2004 | Nemana et al. | |
| 2011/0277377 | A1 | 11/2011 | Novak et al. | |
| 2013/0014431 | A1 | 1/2013 | Jin et al. | |
| 2013/0109895 | A1 | 5/2013 | Novak et al. | |
| 2014/0299515 | A1 | 10/2014 | Weiss et al. | |
| 2014/0332444 | A1 | 11/2014 | Weiss et al. | |
| 2015/0240174 | A1 | 8/2015 | Bru et al. | |
| 2015/0337225 | A1 | 11/2015 | Kraus et al. | |
| 2015/0337226 | A1 | 11/2015 | Tardif et al. | |
| 2015/0353851 | A1 | 12/2015 | Buchanan | |
| 2016/0122662 | A1 | 5/2016 | Weiss et al. | |
| 2016/0122666 | A1 | 5/2016 | Weiss et al. | |
| 2016/0160139 | A1 | 6/2016 | Dawe et al. | |
| 2016/0312130 | A1 | 10/2016 | Majcher et al. | |
| 2017/0009163 | A1 | 1/2017 | Kraus et al. | |
| 2017/0183575 | A1 * | 6/2017 | Rubin-Pitel | C10G 67/049 |
| 2017/0233670 | A1 | 8/2017 | Feustel et al. | |
| 2018/0037308 | A1 | 2/2018 | Lee et al. | |
| 2018/0134974 | A1 | 5/2018 | Cloupet et al. | |
| 2018/0163144 | A1 | 6/2018 | Weiss et al. | |
| 2018/0230389 | A1 | 8/2018 | Moore et al. | |
| 2018/0355263 | A1 | 12/2018 | Moore et al. | |
| 2018/0361312 | A1 | 12/2018 | Dutra e Mello et al. | |
| 2019/0002772 | A1 | 1/2019 | Moore et al. | |
| 2019/0010405 | A1 * | 1/2019 | Moore | C10G 45/04 |
| 2019/0010408 | A1 | 1/2019 | Moore et al. | |
| 2019/0016980 | A1 | 1/2019 | Kar et al. | |
| 2019/0093026 | A1 | 3/2019 | Wohaibi et al. | |
| 2019/0099706 | A1 | 4/2019 | Sampath | |
| 2019/0127651 | A1 | 5/2019 | Kar et al. | |
| 2019/0128160 | A1 | 5/2019 | Peng | |
| 2019/0136144 | A1 | 5/2019 | Wohaibi et al. | |
| 2019/0153340 | A1 | 5/2019 | Weiss et al. | |
| 2019/0153942 | A1 | 5/2019 | Wohaibi et al. | |
| 2019/0185772 | A1 | 6/2019 | Berkhous et al. | |
| 2019/0201841 | A1 | 7/2019 | McClelland | |
| 2019/0203130 | A1 | 7/2019 | Mukherjee | |
| 2019/0233741 | A1 | 8/2019 | Moore et al. | |
| 2019/0338205 | A1 | 11/2019 | Duke | |
| 2019/0382668 | A1 | 12/2019 | Klussman et al. | |
| 2020/0095509 | A1 | 3/2020 | Moore et al. | |
| 2020/0123458 | A1 * | 4/2020 | Moore | C10G 69/04 |
| 2020/0199462 | A1 | 6/2020 | Klussman et al. | |
| 2020/0385644 | A1 | 12/2020 | Rogel et al. | |
| 2021/0238487 | A1 | 8/2021 | Moore et al. | |
| 2021/0284919 | A1 | 9/2021 | Moore et al. | |
| 2021/0292661 | A1 | 9/2021 | Klussman et al. | |
| 2021/0403819 | A1 | 12/2021 | Moore et al. | |

FOREIGN PATENT DOCUMENTS

| | | |
|---|---|---|
| CN | 203816490 | 9/2014 |
| CN | 104353357 | 2/2015 |
| CN | 204170623 | 2/2015 |
| CN | 103331093 | 4/2015 |

(56) References Cited

FOREIGN PATENT DOCUMENTS

| | | |
|---|---|---|
| CN | 204253221 | 4/2015 |
| CN | 204265565 | 4/2015 |
| CN | 105148728 | 12/2015 |
| CN | 103933845 | 1/2016 |
| CN | 105289241 | 2/2016 |
| CN | 105536486 | 5/2016 |
| CN | 105804900 | 7/2016 |
| CN | 103573430 | 8/2016 |
| CN | 104326604 | 11/2016 |
| CN | 104358627 | 11/2016 |
| CN | 106237802 | 12/2016 |
| CN | 205779365 | 12/2016 |
| CN | 105778987 | 8/2017 |
| CN | 108179022 | 6/2018 |
| CN | 108704478 | 10/2018 |
| CN | 14t109126458 | 1/2019 |
| CN | 109423345 | 3/2019 |
| CN | 109499365 | 3/2019 |
| CN | 109705939 | 5/2019 |
| CN | 109722303 | 5/2019 |
| CN | 110129103 | 8/2019 |
| CN | 110229686 | 9/2019 |
| CN | 209451617 | 10/2019 |
| DE | 102010017563 | 12/2011 |
| EP | 1600491 | 11/2005 |
| EP | 2955345 | 12/2015 |
| EP | 3130773 | 2/2017 |
| EP | 3139009 | 3/2017 |
| EP | 3239483 | 11/2017 |
| EP | 3085910 | 8/2018 |
| EP | 3355056 | 8/2018 |
| EP | 2998529 | 2/2019 |
| EP | 3441442 | 2/2019 |
| FR | 3004722 | 3/2016 |
| FR | 3027909 | 5/2016 |
| FR | 3067036 | 12/2018 |
| FR | 3067037 | 12/2018 |
| FR | 3072684 | 4/2019 |
| FR | 3075808 | 6/2019 |
| JP | 3160405 | 6/2010 |
| JP | 2015059220 | 3/2015 |
| JP | 2019014275 | 1/2019 |
| KR | 101751923 | 7/2017 |
| KR | 101823897 | 3/2018 |
| KR | 20180095303 | 8/2018 |
| KR | 20190004474 | 1/2019 |
| KR | 20190004475 | 1/2019 |
| RU | 2673558 | 11/2018 |
| RU | 2700705 | 9/2019 |
| WO | 2008088294 | 7/2008 |
| WO | 2012026302 | 3/2012 |
| WO | 2012089776 | 7/2012 |
| WO | 2012108584 | 8/2012 |
| WO | 2014096703 | 6/2014 |
| WO | 2014096704 | 6/2014 |
| WO | 422014096704 | 6/2014 |
| WO | 2014191004 | 7/2014 |
| WO | 2014177424 | 11/2014 |
| WO | 2014202815 | 12/2014 |
| WO | 2018073018 | 4/2016 |
| WO | 2016167708 | 10/2016 |
| WO | 2017067088 | 4/2017 |
| WO | 2018122274 | 7/2018 |
| WO | 2018/148675 | 8/2018 |
| WO | 2018/148681 | 8/2018 |
| WO | 2018231105 | 12/2018 |
| WO | 2019053323 | 3/2019 |
| WO | 2019104243 | 5/2019 |
| WO | 2019155183 | 8/2019 |
| WO | 2019178701 | 9/2019 |

OTHER PUBLICATIONS

Vivek Rathor et al., Assessment of crude oil blends, refiner's assessment of the compatibility of opportunity crudes in blends aims to avoid the processing problems introduced by lower-quality feedstocks, www.digitalrefining.com/article/1000381, 2011.

International Standard, ISO 8217, Petroleum products—Fuels (class F)—Specifications of marine fuels, Sixth Edition, 2017.

International Standard, 10307-1, Petroleum products—Total sediment in residual fuel oils—, Part 1: Determination by hot filtration, Second Edition, 2009.

International Standard, ISO 10307-2, Petroleum products—Total sediment in residual fuel oils—Part 2: Determination using standard procedures for ageing, Second Edition, 2009.

* cited by examiner

LOW SULFUR FUEL OIL BLENDS FOR PARAFFINIC RESID STABILITY AND ASSOCIATED METHODS

CROSS-REFERENCE TO RELATED APPLICATIONS

The present application claims priority to and the benefit of U.S. Provisional Patent Application No. 62/978,798, titled Low Sulfur Fuel Oil Blending for Stability Enhancement and Associated Methods, filed on Feb. 19, 2020, and U.S. Provisional Patent Application No. 63/199,188, titled Low Sulfur Fuel Oil Blending for Paraffinic Resid Stability and Associated Methods, filed on Dec. 11, 2020, the disclosures of which are incorporated herein by reference in their entirety.

FIELD OF THE DISCLOSURE

Embodiments herein generally relate to fuel oil compositions. More specifically, one or more embodiments relate to low sulfur marine bunker fuel oil compositions, and methods of blending such compositions.

BACKGROUND

The International Marine Organization (IMO) operates as an agency of the United Nations (originally formed in 1948 as the Inter-Governmental Maritime Consultative Organization) and sets global standards for the safety and security of international shipping as well as the prevention of environmental pollution by such shipping. The promotion of sustainable shipping and maritime development has been a major goal of IMO in recent years. To that end, the Marine Environment Protection Committee, the working arm of IMO charged with addressing environmental issues, has adopted more stringent worldwide marine sulfur standards for all maritime transport. These increased standards took effect in 2020 and are set forth in ISO 8217 Petroleum Products-Fuels (Class F)-Specifications of Marine Fuels, published by the International Organization for Standardization ("IMO 2020"). The United States has been a member of IMO since 1950 and has since that time enforced the maritime compliance of all IMO regulations Maritime transportation operates as a critical part of the global economy, responsible for more than 80% of global trade by volume. At least 10% of such trade originates from U.S. ports. This global shipping volume comes with a large global oil demand, which has been estimated by the International Energy Agency to be approximately 4.3 million barrels per day, which is equivalent to about 4% of the global energy demand. The IMO 2020 standards implement a requirement to reduce sulfur in traditional marine fuel—high sulfur fuel oils—to be less than 0.5% by weight (less than 5000 wppm). Thus, the effect of the IMO 2020 standards significantly impacts scope and volume.

Compliance with the IMO 2020 regulations resides with vessel owners and operators, which employ marine fuels—otherwise known as bunker fuels—for powering maritime vessels globally. Generally, there exists three options for such vessel owners and operators to comply with the IMO 2020 regulations: First, they can use a marine bunker fuel oil having less than 0.5% sulfur by weight. Second, they can continue to use high sulfur marine fuel oils and install a scrubber on the maritime vessel to remove sulfur from the combustion gases or emissions. Or, thirdly, they can switch to alternative fuels, such as natural gas, with low sulfur content that alternatively meet the low sulfur requirement.

U. S refineries account for approximately 20% of global refining capability. Therefore, the need to produce low sulfur fuel oils for maritime use with sulfur contents less than 0.5% by weight has been and will continue to be a challenge to U.S. refining operations. The dilution of high sulfur fuel oils with low sulfur distillates to meet the low sulfur, viscosity, and the other fuel specifications of IMO 2020, has been a strategy of many refiners. Asphaltene precipitation, however, continues to be problematic.

In an attempt to prevent asphaltene precipitation upon mixing high sulfur fuel oils with low sulfur distillates, refiners have increasingly turned to proprietary additives to facilitate maintaining asphaltenes in solution. Such stop gap measures are expensive and tenuous at best when solving the larger problem of fuel compatibility and/or stability. What is needed therefore is a fuel oil blend and method of blending that meets the specifications of IMO 2020 (see ISO 8217), including its low sulfur requirement, while achieving initial compatibility and longer term stability.

SUMMARY

In the wake of IMO 2020, the enhancement of a residual hydrocarbon fraction or residuum (resid) through the utilization of low sulfur distillates and cracked stocks may be used to produce low sulfur fuel oil (LSFO), otherwise known as low sulfur marine bunker fuel oil. Enhancement of the residual base stock permits otherwise non-compliant hydrocarbon streams to become economically viable blends for sale e.g., as a product in the LSFO market. Enhancement of resid base stocks with low sulfur distillate, decant oil, cracked hydrocarbon fractions, or a combination thereof also facilitates the creation of marine and other fuels which are economically advantageous, because they often use greater amounts of lower cost, heavier blend components in the final blend. However, the blending of residuum with distillates and other refined products can cause initial compatibility and/or longer term stability problems, such as asphaltene precipitation. Herein, Applicant discloses one or more embodiments of low sulfur fuel oil blend compositions and methods of making such blend compositions to increase the stability and compatibility of LSFO blends having paraffinic resids that are blended with distillates and/or cracked stocks of higher asphaltene and aromatic content.

In one or more embodiments, a method of making and distributing a low sulfur marine bunker fuel oil composition that has an increased initial compatibility and longer term stability is disclosed. A resid, which may be one or more of an atmospheric tower bottoms resid or a vacuum tower bottoms resid, is selected that has an aromatic content of less than about 50% by weight. A first slurry oil is selected that has an aromatic content of greater than about 70% by weight. A second slurry oil is also selected that has an aromatic content of less than about 70% by weight. The first slurry oil and the second slurry oil are blended together in a tank to define a slurry oil mixture having a percentage of aromatics that is less than the aromatic content of the first slurry oil. The resid is then blended into the slurry oil mixture in the tank to define a low sulfur marine bunker fuel oil. In one or more embodiments, the low sulfur marine bunker fuel oil has a sulfur content of less than about 0.5% by weight and an aged sediment of less than about 0.1% by weight. The low sulfur marine bunker fuel oil is then pumped from the tank through a pipeline. In one or more embodiments, the resid may also have a paraffinic content of at least 35% by weight. In at least one embodiment, the method includes acquiring an additional slurry oil have an aromatic content by weight percent less than the aromatic content by weight percent of previously added slurry oil, blending the additional slurry oil into the slurry oil mixture in the tank, and maintaining the percentage of aromatics in the slurry oil mixture less than the aromatic content of the first slurry oil prior to blending the resid therewith.

In one or more embodiments, a method of making and distributing a low sulfur marine bunker fuel oil composition that has an increased initial compatibility and longer term stability is disclosed. A resid, which may be one or more of an atmospheric tower bottoms resid or a vacuum tower bottoms resid, is selected that has a paraffinic content of at least 35% by weight. A first slurry oil is selected that has an aromatic content of greater than about 65% by weight. A second slurry oil is also selected that has an aromatic content that is between about 1% and about 20% lower than the aromatic content of the first slurry. The first slurry oil and the second slurry oil are added to a mixing tank. The first slurry oil and the second slurry oil are blended together to define a slurry oil mixture that has a percentage of aromatics that is less than the aromatic content of the first slurry oil. The resid is then added to the tank and blended with the slurry oil mixture to define a low sulfur marine bunker fuel oil. In one or more embodiments, the low sulfur marine bunker fuel oil has a sulfur content less than about 0.5% by weight and an aged sediment of less than about 0.1% by weight. The low sulfur marine bunker fuel oil is then pumped from the tank through a pipeline. In one or more embodiments, the resid may also have an aromatic content of less than about 50% by weight.

In one or more embodiments, a low sulfur marine bunker fuel oil composition that has an increased initial compatibility and longer term stability is disclosed. The composition includes a first slurry oil having an aromatic content of greater than about 70% by weight, a second slurry oil having an aromatic content of less than about 70% by weight. The second slurry oil and the first slurry oil are blended into a slurry oil mixture, and a resid is added that has a paraffinic content of at least 35% by weight and an aromatic content of less than about 50% by weight. The resid is added to the slurry oil mixture to define a low sulfur marine bunker fuel oil that has a sulfur content less than about 0.5% by weight and an aged sediment of less than about 0.1% by weight.

In one or more embodiments, a low sulfur marine bunker fuel oil composition that has an increased initial compatibility and longer term stability is disclosed. The composition includes a plurality of slurry oils with at least one of the plurality of slurry oils having an aromatic content of greater than about 70% by weight and at least another of the plurality of the slurry oils having an aromatic content of less than about 70% by weight. The one of the plurality of slurry oils and the another of the plurality of slurry oils being blended into a slurry oil mixture, and a resid is added having a paraffinic content of at least 35% by weight and an aromatic content that is at most about 20% by weight lower than the aromatic content of the another of the plurality of slurry oils. The resid is added to the slurry oil mixture to define a low sulfur marine bunker fuel oil that has a sulfur content less than about 0.5% by weight and an aged sediment of less than about 0.1% by weight.

In one or more embodiments, a low sulfur marine bunker fuel oil composition that has an increased initial compatibility and longer term stability is disclosed. The composition includes a plurality of slurry oils with each of the plurality of slurry oils having an aromatic content that is within about 20% by weight of the aromatic content of at least one other of the plurality of slurry oils. The plurality of slurry oils is blended into a slurry oil mixture, and a resid is added having a paraffinic content of at least 35% by weight and an aromatic content that is at most about 20% by weight lower than the aromatic content of at least one of the plurality of slurry oils. The resid is added to the slurry oil mixture to define a low sulfur marine bunker fuel oil that has a sulfur content less than about 0.5% by weight and an aged sediment of less than about 0.1% by weight.

In one or more embodiments, a controller to operate making and distributing of a low sulfur marine bunker fuel oil composition that has an increased initial compatibility and longer term stability is disclosed. The controller may include one or more processors and memory to store instructions. The one or more processors may execute the instructions stored in the memory. The instructions may, when executed via the one or more processors, select a resid that has a paraffinic content of at least 35% by weight and/or an aromatic content of less than about 50% by weight. The instructions may, when executed via the one or more processors, select a first slurry oil having an aromatic content of greater than about 65% or 70% aromatic content. The instructions may, when executed via the one or more processors, select a second slurry oil having an aromatic content less than the aromatic content of the second slurry oil. In response to a selection of the first slurry oil and the second slurry oil, the instructions, when executed by the one or more processors, may initiate transportation of the first slurry oil and the second slurry oil to a blend tank. Upon reception of the first slurry oil and the second slurry oil by the blend tank, the instructions may, when executed via the one or more processors, initiate blending of the first slurry oil and the second slurry oil for a length of time.

After the length of time, the controller may determine whether a correct percentage of aromatics exists in the mixture or at least one component of the mixture is at the correct aromatic content relative to the aromatic content of the resid. In response to a determination that the mixture does not have a correct percentage of aromatics or at least one component of the mixture is not at the correct aromatic content, the instructions may, when executed by the one or more processors, select another slurry oil at another aromatic content. The instructions may, when executed by the one or more processors, initiate transportation of the another slurry oil to the blend tank. Upon reception of the another slurry oil in the blend, the instructions may, when executed by the one or more processors, initiate blending for a length of time. In response to a determination that the mixture is at the correct percentage of aromatics or at least one component of the mixture is at the correct aromatic content, the instructions may, when executed by the one or more processors, initiate transport of the resid to the blend tank. The instructions may, when executed by one or more processors, initiate the blending of the resid with the mixture in the blend tank. After another length of time, the instructions may, when executed by the one or more processors, initiate the pumping of the mixture from the blend tank through a pipeline.

In another embodiment, the controller may be in signal communication with a sensor disposed in or on the blend tank. The sensor may determine or measure characteristics of the mixture. The characteristics may include aromatic or paraffinic content. The controller may be in signal communication with one or more slurry oil valves to control an amount of one or more slurry oils to be transported to the blend tank. The controller may be in signal communication with one or more resid valves to control an amount of one or more resids to be transported to the blend tank. The controller may be in signal communication with one or more distillate valves to control an amount of one or more distillates to be transported to the blend tank. The controller may be in signal communication with a slurry pump, resid pump, and distillate pump to control when the slurry pump, resid pump, and distillate pump is active. The controller may be in signal communication with a user interface. Varying amounts of one or more or two or more slurry oils, one or more resids, and/or one or more distillates may be input at the user interface to be added at certain periods of time for blending in the blend tank.

BRIEF DESCRIPTION OF DRAWINGS

These and other features, aspects, and advantages of the disclosure will become better understood with regard to the following descriptions, claims, and accompanying drawings. It is to be noted, however, that the drawings illustrate only several embodiments of the disclosure and, therefore, are not to be considered limiting of the scope of the disclosure.

DETAILED DESCRIPTION

Figure 1:
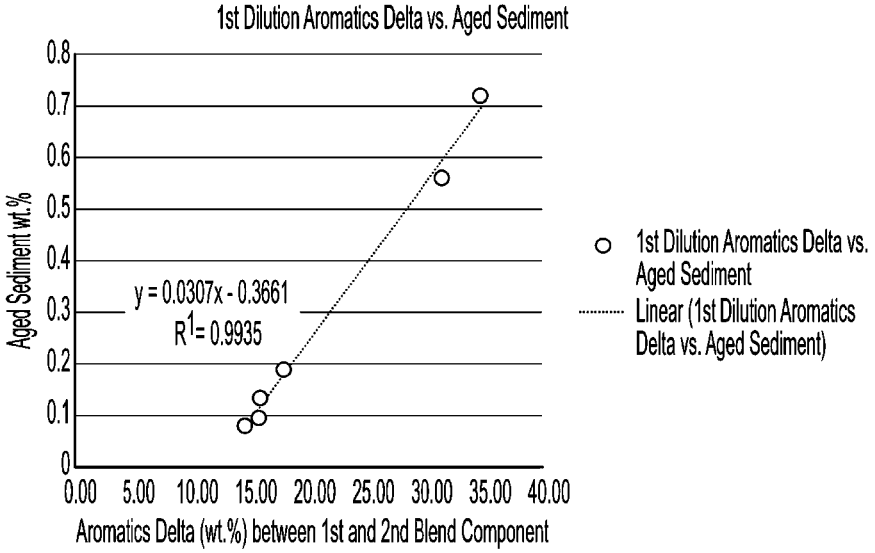
FIG. 1 is a plot of aromatics delta in weight percent between the first and second blend component versus aged sediment weight percent, according to one or more embodiments disclosed herein.

So that the manner in which the features and advantages of the embodiments of the systems and methods disclosed herein, as well as others, which will become apparent, may be understood in more detail, a more particular description of embodiments of systems and methods briefly summarized above may be had by reference to the following detailed description of embodiments thereof, in which one or more are further illustrated in the appended drawings, which form a part of this specification. It is to be noted, however, that the drawings illustrate only various embodiments of the embodiments of the systems and methods disclosed herein and are therefore not to be considered limiting of the scope of the systems and methods disclosed herein as it may include other effective embodiments as well.

With the implementation of lower sulfur specifications for marine fuel oil under IMO 2020, refiners have explored blends of higher sulfur refinery products, such as resid, with lower sulfur cutter stocks, e.g., distillates and cracked stocks, in order to meet the low sulfur requirements and other fuel specifications. However, the blend must have initial compatibility in order to prevent asphaltenes suspended in the heavy blend fraction from precipitating out of solution upon blending. Moreover, the blend must also have longer term stability, such that the asphaltenes present in the heavy blend fraction remain in solution over time during sale, distribution, and other outputting, e.g., during storage and/or transport.

Certain resids, however, depending on the crude oil feedstock and/or the refinery processing, may be low in sulfur, e.g., less than 1.25 wt %, less than 1.0 wt %, less than 0.75 wt %, or even less than 0.5 wt %, such that a higher sulfur distillate or cracked stock may be blended therewith to achieve a low sulfur fuel oil (LSFO), e.g., having less than 0.5 wt % sulfur, for use in marine applications. If such resids also have a lower density (i.e., a higher API gravity), then the blending of certain distillates and/or cracked stock can heavy up or increase the density of the resulting LSFO. Because LSFO is generally sold on the basis of weight, LSFO having denser hydrocarbon components provides greater economic return when sold. Thus, refiners may increase the density of otherwise low sulfur resids by adding higher density distillates and cracked stocks to the resulting LSFO in order to be able to sell the heaviest LSFO that meets the IMO 2020 specifications.

Applicant has recognized, however, that compatibility and/or stability of the LSFO may be a concern if low sulfur resids or base stocks are blended with heavier weight/greater density distillates and/or cracked stocks. This is especially the case if the resids or base stocks are higher in paraffin content, e.g., greater than 25%, greater than 30%, greater than 35%, or even greater than 40%, and the distillates and/or cracked stocks are higher in asphaltene content, i.e., as indicated by the heptane insolubles being greater than those of the resids. Such distillates and/or cracked stocks may have a higher asphaltene content than even the asphaltene contents of the resids. Thus, the Applicant has recognized that incompatibility and/or stability issues may cause the asphaltenes in the distillates and/or cracked stocks to precipitate out upon blending with the paraffinic, and in some cases low asphaltenic, resids.

Nonetheless, the Applicant has further discovered that such incompatibility and/or stability issues may be reduced and/or mitigated if the aromatic content/percentage of the components to be blended (e.g., resid, distillate and cracked stock) are initially considered. Specifically, the Applicant has found that such incompatibility and/or stability may be reduced and/or mitigated by incorporating distillates/hydrocarbon fractions (e.g., certain VGO, diesel fuel, etc.) and/or cracked stocks (e.g., slurry/decant oil, cycle oil, etc.) that incrementally reduce the initial aromaticity of the distillate/hydrocarbon fractions or cracked stock with the highest aromaticity prior to any resid addition. In other words, prior to any resid addition, the component (i.e., distillate or cracked stock) with the highest aromaticity is blended with another component (i.e., another distillate or cracked stock) having a lower aromaticity to create a two-component blend having an aromaticity that is less than the aromaticity of the component with the highest aromaticity. Additional components (i.e., distillate or cracked stock) having incrementally lower aromaticity may be blended with the other blended components to further reduce the aromaticity of the resulting blend. In this way, the Applicant has found that distillates and/or cracked stocks having aromatic contents between the component with highest aromatic content and the resid (or other component having the lowest aromatic content) effectively provide a bridge therebetween to stabilize and/or promote compatibility between the high aromatic distillates and/or cracked stocks and the high paraffinic resid or base stock.

Based on these discoveries by Applicant, several hand blends were made using various resid, distillate and cracked stock components to further identify those blends and methods of making such blends that provide the desired blend compatibility and stability. Table I provides the SARA, density, and other characteristics of two vacuum tower bottoms resids (VTB) that were used in the several blend recipes of TABLE II.

TABLE I

| | VTB #1 | VTB #2 |
|---|---|---|
| Saturates wt % | 35.23 | 39.42 |
| Aromatics wt % | 47.27 | 43.97 |
| Resins wt % | 14.05 | 14.62 |
| Asphaltenes wt % | 3.44 | 1.97 |
| Density (g/ml) | 0.96 | 0.95 |
| Heptane Ins. wt % | 0.93 | 0.48 |
| Viscosity | 6333.94 @ 50° C. | 45.12 @ 135° C. |
| MCRT wt % | 10.67 | 7.31 |
| CCAI | 798 | 789 |
| CII | 0.631 | 0.706 |

As provided in TABLE I above, the two VTBs, which were produced at separate refineries, have similar characteristics. For VTB #1, the paraffin content (i.e., saturates) is about 35 wt % and the aromatic content is about 47 wt %. For VTB #2, the paraffin content (i.e., saturates) is about 39 wt % and the aromatic content is about 44 wt %. Both VTB #1 and VTB #2 have relatively low asphaltenes content at about 3.4 wt % and 2.0 wt %, respectively. The density of these resids is also relatively low. As used in this disclosure, the aromatic content is the aromaticity of the component or mixture of components and may be represented as a percentage or concentration of aromatics that may be found in the component or mixture of components.

TABLE II provides the prepared blend recipes that use one of the VTBs of TABLE I along with other slurry oils (i.e., cracked stock) and distillates (i.e., a paraffinic VGO). As is well known to those skilled in the art, decant oil, otherwise known as DCO or slurry oil, is a catalytic cracked aromatic process oil that is the heaviest cut from a fluid catalytic cracker. TABLE II also provides the aromatic content of each of the blended components. The delta or difference of the CCAI values between the first and second blended component are also listed. In preparing these hand blends, the designated first component had the highest aromatic content and the designated second component had the second highest aromatic content. Additional components, if any, were added in the specified quantities in the order of decreasing aromaticity, such that in most cases, the VTB resid and/or the VGO components were blended into the other components last or as a final step.

TABLE II

| | Individual Aromatics wt % | CCAI | Blend #1 wt % | Blend #2 wt % | Blend #3 wt % | Blend #4 wt % | Blend #5 wt % | Blend #6 wt % |
|---|---|---|---|---|---|---|---|---|
| Slurry Oil #1 | 78.54 | 912 | 0 | 30.49 | 31.38 | 30.72 | 30.06 | 0 |
| Slurry Oil #2 | 62.81 | 858 | 0 | 0 | 24.77 | 0 | 23.92 | 0 |
| Slurry Oil #3 | 53.91 | 883 | 0 | 0 | 0 | 0 | 0 | 0 |
| VTB #2 | 43.97 | 789 | 25.09 | 26.89 | 25.08 | 0 | 0 | 0 |
| VTB #1 | 47.27 | 798 | 0 | 0 | 0 | 25.71 | 27.91 | 25 |
| VGO | 29.51 | 766 | 74.91 | 42.62 | 18.78 | 43.56 | 18.1 | 75 |
| Aged Sediment wt % | | | 0.0817 | 0.719 | 0.1327 | 0.5623 | 0.09 | 0.1867 |
| Aromatics Delta wt % | | | 14.46 | 34.57 | 15.73 | 31.27 | 15.73 | 17.76 |
| CCAI Delta | | | 23 | 123 | 54 | 114 | 54 | 32 |

Looking at TABLE II, Blend #1 and Blend #5 have an aged sediment of less than 0.1 percent by weight, which is indicative of a compatible and stable blend. As is well known to those skilled in the art, the aged sediment, also known as total sediment aged, TSP, and total sediment potential, is a characteristic of the fuel oil that for marine fuel oils must be under 0.1 percent weight per the IMO 2020 requirements. Blend #3 has an aged sediment of about 0.13 weight percent, which is not much higher than 0.1%. The other blends (incorporating an oil slurry) have aged sediments well above the 0.1 percent by weight. Analyzing the data of TABLE II, the compatibility and stability of Blend #5 may result from the blending of both Slurry Oil #1 and Slurry Oil #2 prior to adding the VTB #1 and VGO. Slurry Oil #1 has an aromatic content of about 78 wt %, which is above 70 wt %, while Slurry Oil #2 has an aromatic content of about 63 wt %, which is below 70 wt %. Here, the Slurry Oil #2 provides a component to the blend that has an aromatic content that is between the higher aromatic content of the Slurry Oil #1 (aromatic content of about 78 wt %) and the to be added VTB #1 (aromatic content of about 47 wt %). In this way, the addition of the Slurry Oil #2 is believed to bridge the aromaticity concentration of the blend between higher aromatic components and lower aromatic (higher paraffinic) resids and/or distillates. With respect to Blend #5, the aromatic content delta (or the difference between the aromatic weight percentages of the two compared components) is less than 16% between Slurry Oil #1 and Slurry Oil #2 (e.g., 15.73%), less than 16% between Slurry Oil #2 and the VTB #1 (e.g., 15.54%), and less than 18% between the VTB #1 and the VGO (e.g., 17.76%).

Turning now to Blend #3 of TABLE II, the aromatic content delta is less than 16% between Slurry Oil #1 and Slurry Oil #2 (e.g., 15.73%), less than 19% between Slurry Oil #2 and VTB #2 (e.g., 18.84), less than 15% between VTB #2 and VGO (e.g., 14.46). However, the aged sediment of Blend #3 is slightly above 0.1%. Thus, the aromatic content delta between some components of Blend #3 may be too great, e.g., the aromatic content delta between Slurry Oil #2 and VTB #2, or an insufficient amount of one or more of the components relative to the other components may have been used, e.g., a greater amount of Slurry Oil #2 may be needed relative to the amount of VTB #2 used. Here, the components of Blend #3 are about equally present in the final blend (31% Slurry Oil #1, 25% Slurry Oil #2, 25% VTB #2, and 19% VGO). However, slight adjustments in percentages of one or more components relative to the others may produce an aged sediment of less than 0.1%, especially since the aromatic content deltas of all the components are below about 20%. Thus, compatibility and stability of the LSFO blend may be realized, as evidenced by an aged sediment of less than 0.1 wt %, if the aromatic content delta is no more than about 18%, no more than about 16%, no more than about 14%, no more than about 12%, no more than about 10%, no more than about 5% or no more than about 1%, or any percent thereinbetween. In other embodiments, an aromatic content delta of as much at 20% may yield a compatible and stable blend having an aged sediment of less than 0.1 wt %.

When the aromatic content delta between components of the blend is greater than about 20%, the incompatibility and instability of the resulting blend becomes more apparent. For example, in Blend #2 of TABLE II, the aromatic content delta between Slurry Oil #1 and the VTB #2 is greater than 34% (e.g., 34.57%), which results in an aged sediment of 0.719 wt % for the blend (even after VGO addition), which is well above the 0.1% specification. Similarly, Blend #4 also has a large aromatic content delta between Slurry Oil #1 and VTB #1 (e.g., 31.27%), which may cause the aged sediment to be at 0.5623 wt % for the resulting mixture. In both Blends #2 and #4, the addition of a component or components having an intermediate aromatic content may result in a stable and compatible LSFO, i.e., for the reasons described above with respect to Blend #5 (and Blend #3).

FIG. 1 illustrates a plot of aromatics delta in weight percent between the first and second blend component versus aged sediment in weight percent. The aromatics content delta between the first and second component trends well with the resulting aged sediment. Both of the residuals, VTB #1 and VTB #2, fall on the same trend line. Considering that VTB #1 and VTB #2 have similar characteristics, as previously noted, it would be expected that these two resids would so correlate. As shown in FIG. 1, the cluster of data points below about 0.2 wt % aged sediment have an aromatics delta in weight percent between the first and second component of between about 15% and about 20%. Thus, this plot suggests that an aromatics content delta between the first and second blend component that exceeds from about 16 to 18% is more likely to lead to asphaltenes precipitation. The data in TABLE II, as presented above, indicates the aromatics content delta between each blend component (including between the slurry oils and the resids) could be as high as 16%, 18% or even 20% without leading to asphaltenes precipitation. Now looking at the right hand of the plot of FIG. 1, the two data points with aromatics content deltas well above 20% have aged sediments of well above 0.1%, which is indicative of resulting blends that will precipitate asphaltenes.

TABLE III below provides a representative LSFO blend recipe for resid, distillate, and cracked stock components that may be blended in a blend tank and pumped through a pipeline. As can be understood from TABLE III in conjunction with TABLE I, TABLE VII, and TABLE VIII (each providing component properties and characteristics data), the blend recipe of LSFO #1 has first and second slurry oil components that have aromatic content deltas within 2 wt % of each other (e.g., compare Slurry Oil #1 having an aromatics content of 78.54 wt % with Slurry Oil #4 having an aromatics content of 77.14 wt %). In fact, each of the components of LSFO #1 has an aromatics content within about 16 wt % of the component with the next highest aromatics content. TABLE IV provides an analysis of the characteristics of the resulting LSFO #1, in which the slurry oil with the highest aromatics content is blended with the slurry oil with the next highest aromatics content and so on until the all of the listed components (including the resids) are fully blended. An unexpected result of the blend recipe of LSFO #1 is that no distillate (e.g., VGO) is needed or blended therewith to reduce sulfur, lower viscosity, or otherwise conform the final blend to the IMO 2020 specifications. From TABLE IV, the total sulfur content of LSFO #1 is less than 0.5 wt %, and the API gravity is less than 16. Finally, the aged sediment of LSFO #1 was below 0.1 wt %, which is indicative of a compatible and stable blend.

TABLE III

| LSFO # | |
|---|---|
| Component | wt % |
| Slurry Oil #1 | 19 |
| Slurry Oil #4 | 9 |
| Slurry Oil #2 | 16 |
| Slurry Oil #3 | 4 |
| VTB #1 | 20 |
| ATB #1 | 16 |
| ATB #2 | 16 |
| Total | 100 |

TABLE IV

| Method | Test | Result |
|---|---|---|
| ASTM D4052 | API Gravity @ 60° F., API | 15.9 |
| ASTM D445 | Kinematic Viscosity at 50° C., $mm^2/s$ | 36.03 |
| ASTM D4234 | Total Sulfur Content, % (m/m) | 0.474 |
| IP501 | Aluminum, mg/kg | 23 |
| | Silicon, mg/kg | 34 |
| | Aluminum + Silicon, mg/kg | 57 |
| | Sodium, mg/kg | 7 |
| | Vanadium, mg/kg | <1 |
| ASTM D4870 | Accelerated Total Sediment, % (m/m) | 0.03 |
| | Potential Total Sediment, % (m/m) | |
| ASTM D4740 | Cleanliness Rating | 2 |
| | Compatibility Rating | 2 |

TABLE V below provides another representative LSFO blend recipe for resid, distillate, and cracked stock components that may be blended in a blend tank and pumped through a pipeline. As can be understood from TABLE V in conjunction with TABLE I, TABLE VII, and TABLE VIII (each providing component properties and characteristics data), the blend recipe of LSFO #2 has first and second slurry oil components that have aromatic content deltas within 3 wt % of each other (e.g., compare Slurry Oil #5 having an aromatics content of 81.1 wt % with Slurry Oil #1 having an aromatics content of 78.54 wt %). In fact, each of the components of LSFO #2 has an aromatics content within about 15 wt % of the component with the next highest aromatics content. TABLE VI provides an analysis of the characteristics of the resulting LSFO #2, in which the component (whether slurry oil, resid, or distillate) with the highest aromatics content is blended with the slurry oil with the next highest aromatics content and so on until the all of the listed components (including the resid and distillate components) are fully blended. An unexpected result of the blend recipe of LSFO #2 is that less than about 10% of a distillate (e.g., VGO) is needed or blended therewith to reduce sulfur, lower viscosity, or otherwise conform the final blend to the IMO 2020 specifications. Based on the blend recipes of LSFO #1 and LSFO #2, the weight percent of distillate added may less than about 10%, less than about 5%, less than about 2%, or even 0%. From TABLE VI, the total sulfur content of LSFO #2 is less than 0.5 wt %, and the API gravity is less than 14. Finally, the aged sediment of LSFO #2 was below 0.1 wt %, which is indicative of a compatible and stable blend.

TABLE V

| LSFO #2 | |
|---|---|
| Component | wt % |
| Slurry Oil #1 | 11 |
| Slurry Oil #4 | 11 |
| Slurry Oil #2 | 9 |
| Slurry Oil #3 | 6 |
| Slurry Oil #5 | 6 |
| VTB #1 | 11 |
| VTB #3 | 10 |
| ATB #1 | 9 |
| ATB #2 | 9 |
| ATB #3 | 9 |
| VGO | 9 |
| Total | 100 |

TABLE VI

| Method | Test | Result |
|---|---|---|
| ASTM D4052 | API Gravity @ 60° F., API | 13.8 |
| ASTM D445 | Kinematic Viscosity at 50° C., $mm^2/s$ | 123.9 |
| ASTM D4234 | Total Sulfur Content, % (m/m) | 0.459 |
| IP501 | Aluminum, mg/kg | 23 |
| | Silicon, mg/kg | 32 |
| | Aluminum + Silicon, mg/kg | 55 |
| | Sodium, mg/kg | 5 |
| | Vanadium, mg/kg | 2 |
| ASTM D4870 | Accelerated Total Sediment, % (m/m) | 0.05 |
| | Bath Verification | Yes |
| | Potential Total Sediment, % (m/m) | |
| ASTM D4740 | Cleanliness Rating | 2 |
| | Compatibility Rating | 2 |

TABLE VII

| Component | Saturates wt % | Aromatics wt % | Resins wt % | Asphaltenes wt % | Sulfur wt % | Density @ 15° C. (g/m1) | Heptane Ins. wt % | Viscosity @ 50° C. cSt | MCRT wt % | CCAI | CII | Sat/ Res |
|---|---|---|---|---|---|---|---|---|---|---|---|---|
| Slurry Oil #3 | 39.09 | 53.91 | 6.55 | 0.45 | 0.587 | 1 | 0.72 | 68.47 | 5.42 | 883 | 0.654 | 5.968 |
| Slurry Oil #2 | 31.32 | 62.81 | 5.31 | 0.56 | 0.517 | 0.99 | 0.3 | 25.40 | 2.69 | 858 | 0.468 | 5.898 |
| Slurry Oil #4 | 16.53 | 77.14 | 5.39 | 0.95 | 0.0645 | 1.05 | 1.59 | 49.79 | 6.89 | 937 | 0.212 | 3.067 |
| Slurry Oil #1 | 16.83 | 78.54 | 3.46 | 1.16 | 1.11 | 1.05 | 5.28 | 345.79 | 9.61 | 912 | 0.219 | 4.864 |
| Slurry Oil #5 | 11.3 | 81.1 | 4.7 | 2.9 | 0.185 | 1.1 | 8.7 | 581.60 | 15 | 957 | 0.166 | 2.404 |

TABLE VIII

| Component | Saturates wt % | Aromatics wt % | Resins wt % | Asphaltenes wt % | Density @ 15° C. (g/m1) | Heptane Ins. wt % | Viscosity @ 50° C. cSt | MCRT wt % | CCAI | CII | Sulfur wt % |
|---|---|---|---|---|---|---|---|---|---|---|---|
| ATB #3 | 50.19 | 46.7 | 2.21 | 0.9 | 0.92 | 0.55 | 92.28 | 1.82 | 798 | 1.045 | 0.188 |
| ATB #2 | 8.55 | 36.93 | 3.3 | 1.18 | 0.89 | 0.61 | 31.01 | 1.57 | 784 | 0.242 | 0.221 |
| ATB #1 | 66.21 | 21.46 | 5.77 | 6.56 | 0.85 | 0.73 | 45.33 | 1.94 | 738 | 2.672 | 0.262 |
| VGO | 68.68 | 29.51 | 1.81 | 0 | 0.89 | | 115.19 | 0.28 | 766 | 2.247 | 0.245 |
| VTB #3 | 22.63 | 59.59 | 15.44 | 2.34 | 0.98 | 1.91 | 53.72 | 11.24 | 817 | 0.333 | 0.78 |

TABLE IX below provides another representative LSFO blend recipe for resid, distillate, and cracked stock components that may be blended in a blend tank and pumped through a pipeline. As can be understood from TABLE IX in conjunction with TABLE I, TABLE VII, and TABLE VIII (each providing component properties and characteristics data), the blend recipe of LSFO #3 has first and second slurry oil components that again have aromatic content deltas within 2 wt % of each other (e.g., compare Slurry Oil #1 having an aromatics content of 78.54 wt % with Slurry Oil #4 having an aromatics content of 77.14 wt %). In fact, each of the components of LSFO #3 has an aromatics content within about 15 wt % of the component with the next highest aromatics content. TABLE X provides an analysis of the characteristics of the resulting LSFO #3, in which the component (whether slurry oil, resid, or distillate) with the highest aromatics content is blended with the slurry oil with the next highest aromatics content and so on until the all of the listed components (including the resid and distillate components) are fully blended. From TABLE X, the total sulfur content of LSFO #3 is less than 0.5 wt %, and the API gravity is less than 18.5. Finally, the aged sediment of LSFO #3 was below 0.1 wt %, which is indicative of a compatible and stable blend.

TABLE IX

| LSFO #3 | |
|---|---|
| Component | wt % |
| Slurry Oil #1 | 14 |
| Slurry Oil #4 | 10 |
| Slurry Oil #2 | 9 |
| Slurry Oil #3 | 4 |
| VTB #1 | 14 |
| ATB #2 | 3 |
| ATB #3 | 15 |
| VGO | 31 |
| Total | 100 |

TABLE X

| Method | Test | Result |
|---|---|---|
| ASTM D4052 | API Gravity @ 60° F., API | 18.4 |
| ASTM D445 | Kinematic Viscosity at 50° C., $mm^2/s$ | 71.35 |
| ASTM D4294 | Total Sulfur Content, % (m/m) | 0.399 |
| ASTM D97 | Pour Point, ° C. | 0 |
| | Pour Point, ° F. | 32 |
| ASTM D4870 | Accelerated Total Sediment, % (m/m) | 0.05 |
| | Potential Total Sediment, % (m/m) | 0.04 |
| ASTM D7061 | Dilution Ratio | 1 to 9 |
| | Separability Number, % | 0.3 |
| ASTM D4740 | Cleanliness Rating | 2 |
| | Compatibility Rating | 3 |

TABLE XI below provides another representative LSFO blend recipe for resid, distillate, and cracked stock components that may be blended in a blend tank and pumped through a pipeline. As can be understood from TABLE XI in conjunction with TABLE I, TABLE VII, and TABLE VIII (each providing component properties and characteristics data), the blend recipe of LSFO #4 has a single slurry oil component that has an aromatic content delta within 7 wt % of a resid (e.g., compare Slurry Oil #3 having an aromatics content of 53.91 wt % with VTB #1 having an aromatics content of 47.27 wt %). In fact, the three components of the LSFO #4 with the highest aromatic contents (Slurry Oil #3, VTB #1, and ATB #3) are within about 8 wt % of each other. ATB #1 and ATB #3 have the greatest aromatics content delta at about 25 wt % difference. However, both ATB #1 and ATB #3 are highly paraffinic at 66.21 wt % and 50.19 wt %, respectively, which may compensate for the larger difference in aromatics content delta. TABLE XII provides an analysis of the characteristics of the resulting LSFO #4, in which the blend component with the highest aromatics content is blended with component having the next highest aromatics content and so on until the all of the listed components are fully blended. An unexpected result of the blend recipe of LSFO #4 is that no distillate (e.g., VGO) is needed or blended therewith to reduce sulfur, lower viscosity, or otherwise conform the final blend to the IMO 2020 specifications. From TABLE XII, the total sulfur content of LSFO #4 is less than 0.5 wt %, and the API gravity is less than 20.5. Finally, the aged sediment of LSFO #4 was below 0.1 wt %, which is indicative of a compatible and stable blend.

TABLE XI

| LSFO #4 | |
|---|---|
| Component | wt % |
| Slurry Oil #3 | 20 |
| VTB #1 | 37 |
| ATB #1 | 11 |
| ATB #3 | 32 |
| Total | 100 |

TABLE XII

| Method | Test | Result |
|---|---|---|
| ASTM D4052 | API Gravity @ 60° F., API | 20.4 |
| ASTM D445 | Test Temperature, ° C. | 50 |
| | Kinematic Viscosity at 50° C., $mm^2/s$ | 222.7 |
| ASTM D4294 | Total Sulfur Content, % (m/m) | 0.351 |
| IP501 | Aluminum, mg/kg | 20 |
| | Silicon, mg/kg | 28 |
| | Aluminum + Silicon, mg/kg | 48 |
| ASTM D4870 | Accelerated Total Sediment, % (m/m) | 0.03 |
| | Potential Total Sediment; % (m/m) | |
| ASTM D4740 | Cleanliness Rating | 1 |
| | Compatibility Rating | 2 |

Figure 2:
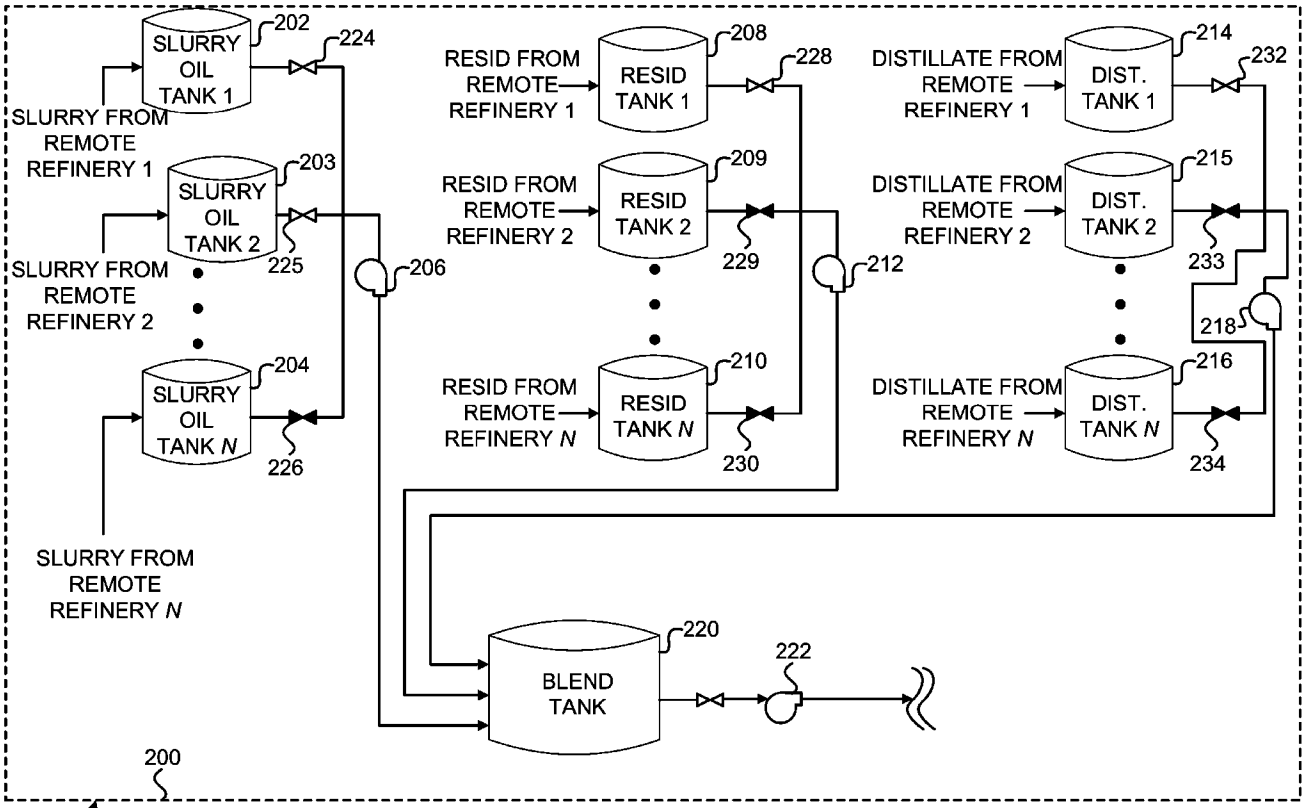
FIG. 2 is a schematic diagram of a terminal that receives and stores various resids, slurry oils, and distillates for blending to create a low sulfur fuel oil for marine applications, according to one or more embodiments disclosed herein.
Figure 3:
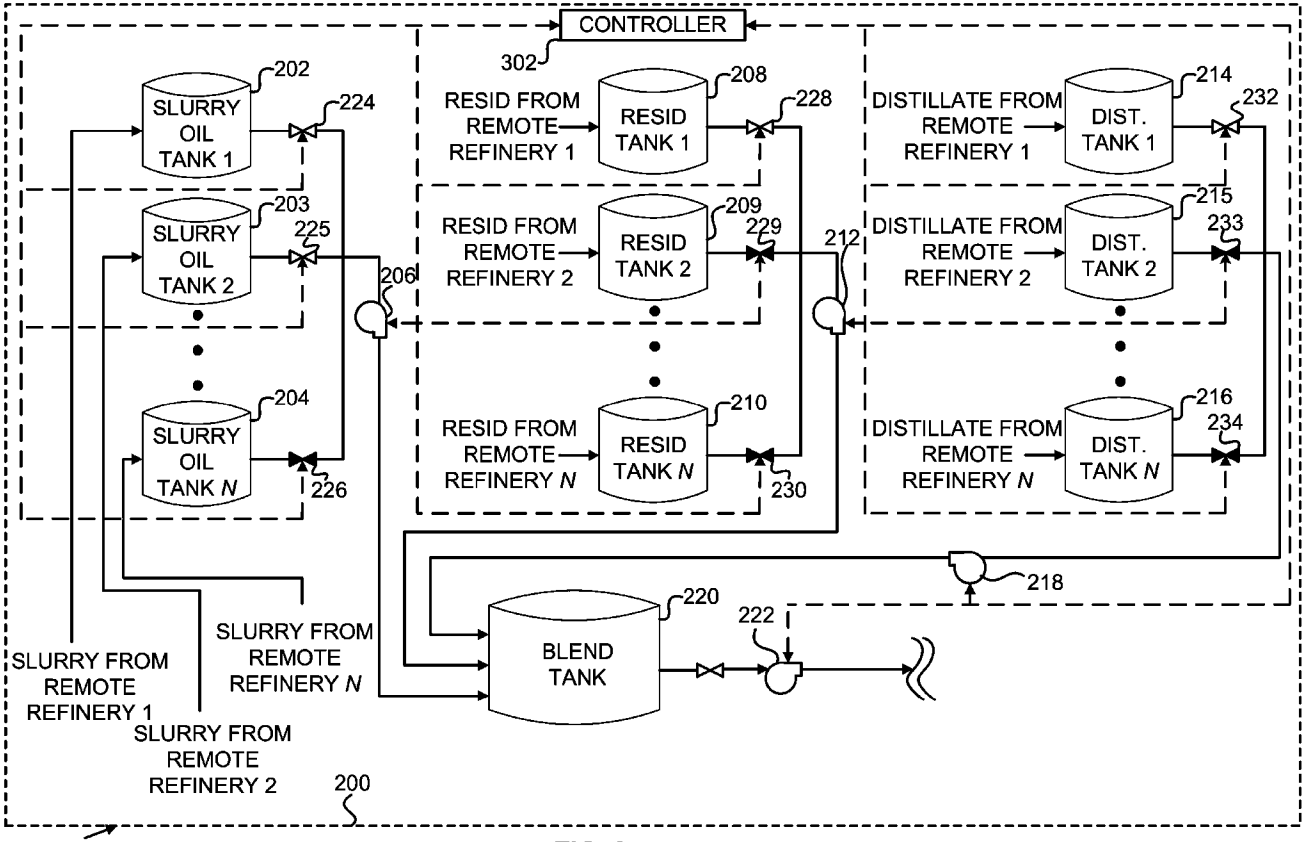
FIG. 3 is a schematic diagram of the terminal of FIG. 2 in which one or more controllers coordinate the blending of specific components to create the low sulfur fuel oil for marine application, according to one or more embodiments disclosed herein.

FIG. 2 is a schematic diagram of a terminal 200 that receives and stores various resids, slurry oils, and distillates for blending to create a low sulfur fuel oil for marine applications, according to one or more embodiments disclosed herein. FIG. 3 is a schematic diagram of the terminal 200 of FIG. 2 in which one or more controllers (e.g., controller 302) coordinate the blending of specific components to create the low sulfur fuel oil for marine application, according to one or more embodiments disclosed herein. In an example, the terminal 200 may include various tanks to store and receive the various resids, slurry oils, and distillates from various sources, such as from different and remote refineries. The various resids, slurry oils, and distillates may be combined in a specified order and mixed or blended for a specified length of time in a blend tank 220. After the various resids, slurry oils, and distillates are blended the resulting blend or mixture may be pumped, via pump 222, to another tank, a vehicle for shipment, or to another location or terminal external to terminal 200.

In an example, the various resids, slurry oils, and distillates may be mixed in a specified order. In such examples, as the various resids, slurry oils, and distillates are added to the blend tank 220, the added various resids, slurry oils, and distillates may mix or blend before additional various resids, slurry oils, and distillates are added. As an example, slurry oil tanks (e.g., slurry oil tank 1 202, slurry oil tank 2 203, and/or up to slurry oil tank N 204) may receive slurry oil of varying aromatic content, weight (e.g., as measured by density or gravity), sulfur content, asphaltene content, and/or exhibiting other characteristics, as described throughout. Further, the resid tanks (e.g., resid tank 1 208, resid tank 2 209, and/or up to resid tank N 210) may receive resid of varying aromatic content, weight (e.g., as measured by density or gravity), sulfur content, asphaltene content, and/or exhibiting other characteristics, as described throughout. Further still, the distillate tanks (e.g., distillate tank 1 214, distillate tank 2 215, and/or up to distillate tank N 216) may receive distillate of varying aromatic content, weight (e.g., as measured by density or gravity), sulfur content, asphaltene content, and/or exhibiting other characteristics, as described throughout.

As the various resids, slurry oils, and distillates are received at the terminal 200, the characteristics may be transported or transferred (e.g., transmitted) to the terminal 200 or a controller 302. In such examples, the characteristics may be transported or transferred to the terminal 200 or controller 302 as an electronic record (e.g., via a machine readable storage medium or via an electronic or signal communication), as a paper form, as a ticket, or as another suitable medium for transporting or transferring information. Once the terminal 200 has received the appropriate components for a particular or specified blend and once the terminal 200 and/or controller 302 has received the corresponding data, the terminal 200, controller 302, or a user may initiate a blending operation or process.

In response to initiation of a blending operation or process, a user and/or the controller 302 may select a first slurry oil (e.g., from slurry oil tank 1 202) and a second slurry oil (e.g., from slurry oil tank 2 203). In another example, other slurry oils may be selected from other slurry tanks. In another example, all slurry oils to be blended and/or all of the various resids, slurry oils, and distillates may be selected prior to initialization of the blending operation or process, by the user and/or the controller 302. In yet another example, the various resids, slurry oils, and distillates may be selected at different times or intervals of the blending operation or process.

Once a first slurry oil (e.g., from slurry oil tank 1 202) and a second slurry oil (e.g., from slurry oil tank 2 203) are selected, the first slurry oil (e.g., from slurry oil tank 1 202) and a second slurry oil (e.g., from slurry oil tank 2 203) may be transported or pumped, via pipeline and pump 206, to a blend tank. Valves (e.g., valve 224 and valve 225) may be opened to allow the corresponding slurry oil to flow to the blend tank 220. Each of the slurry oil tanks (e.g., slurry oil tank 1 202, slurry oil tank 2 203, and/or up to slurry oil tank N 204) may be in fluid communication with a valve (e.g., valve 224, valve 225, and valve 226, respectively) to allow fluid to flow to the blend tank 220 upon opening of the valve. Once the blend tank 220 contains the first slurry oil and second slurry oil, the first slurry oil and second slurry oil (or any other components added at that point) may be blended together for a specified period of time, to ensure proper blending. In an example, the first slurry oil may have a high aromatic content (e.g., greater than about 70% by weight), while the second slurry oil may have a lower aromatic content (e.g., less than about 70% by weight).

Once the first slurry oil and the second slurry oil are mixed or blended, a user or controller 302 may select another slurry oil for blending. The other slurry oil may include an aromatic content less than that of the second slurry oil and closer to the aromatic content of the resid to be mixed (e.g., within 1% to 20%). In an example, the next slurry oil or component to be mixed may be preselected. In other words, all the selected various resids, slurry oils, and distillates may be preselected and loaded into the controller 302 for scheduled mixing or blending (e.g., different components blended for various time intervals and other components added for mixing at other time intervals). In another example, the user or controller 302 may select the next slurry oil or various resids and distillates for blending. The selection may be automatic or a prompt may be displayed on a user interface (e.g., a display or a computing device (e.g., laptop, phone, desktop with display, or terminal)). The user interface may be in signal communication with the controller 302. The prompt may include a list of other available resids, slurry oils, and distillates and the characteristics of those components.

If another slurry oil is selected, the selected slurry oil may be transported or pumped, via pipeline and pump 206, to the blend tank 220. The other slurry oil may then be mixed with the current mixture in the blend tank 220 for a specified period of time. In another example, the characteristics of such a blend or mixture (as well as at any point during the blending operation or process) may be measured either manually (e.g., physically taking a sample and measuring the characteristics in a nearby lab) or via sensors disposed in or on the blend tank 220. Such characteristics may be provided to the user and/or the controller 302. The characteristics may be utilized, by the user and/or the controller 302, to determine if other slurry oils (as well as which resids or distillates) should be added to the mixture or blend. As noted above, in another example, the slurry oils, resids and/or distillates to be blended or mixed may all be preselected before initiation of the blending operation or process.

Once the mixture or blend in the blend tank 220 contains the proper percentage of aromatics (i.e., stepped down in its percentage of aromatics toward the aromatic content of the resid) or if a component of the mixture or blend in the blend tank 220 is of the proper aromatic content (e.g., close to the aromatic content of the resid, such as within 1% to 20% thereof), one or more resids (e.g., from resid tank 1 208, resid tank 2 209, and/or up to resid tank N 210) may be added to the blend tank 220. The one or more resids may have an aromatic content less than that of the first slurry oil and second slurry oil. The resids aromatic content may be close to that of the last slurry oil added to the blend tank 220 (e.g., within about 1% to 20%). The resid may have an aromatic content of less than about 50% by weight. The resids may be added from each corresponding selected resid tanks (e.g., resid tank 1 208, resid tank 2 209, and/or up to resid tank N 210) by opening an associated valve (e.g., valve 228, valve 229, and/or up to valve 230, respectively) and pumping the resid, via pipeline and pump 212, to the blend tank 220. Once the selected resid is added to the blend tank, the resid may be mixed for a specified amount of time.

In some examples, the total weight of the mixture may be too heavy, per specifications. In such examples, the user or controller 302 or based on a preselection may select a distillate to add into the mixture or blend. In another example, the mixture or blend may include too much sulfur by weight, resulting in prevention of classification as a low sulfur fuel. In such cases, distillate with a low sulfur content may be added to the mixture or blend in the blend tank 220. In either case, if a distillate is selected (e.g., from distillate tank 1 214, distillate tank 2 215, and/or up to distillate tank N 216), the corresponding valve (e.g., valve 232, valve 233, and/or up to valve 234, respectively) may be opened to allow for flow of the selected distillate. Further, a pump 218 may pump the distillate to the blend tank 220 via pipeline. In one or more embodiments, the distillate may be added after the last of the slurry oils is added to the blend tank 220 but prior to the resid being added to the blend tank 220. In one or more other embodiments, the distillate may be added after the resid is added to the blend tank 220.

Once the mixture or blend meets specification or once the specified components have been mixed, the characteristics of the mixture or blend may be determined to ensure that the mixture or blend meets specification. In another example, rather than determining characteristics, the mixture or blend may be transported, via pipeline and pump 222, to another tank, a vehicle for shipment, or to another location or terminal external to terminal 200.

Figure 4:
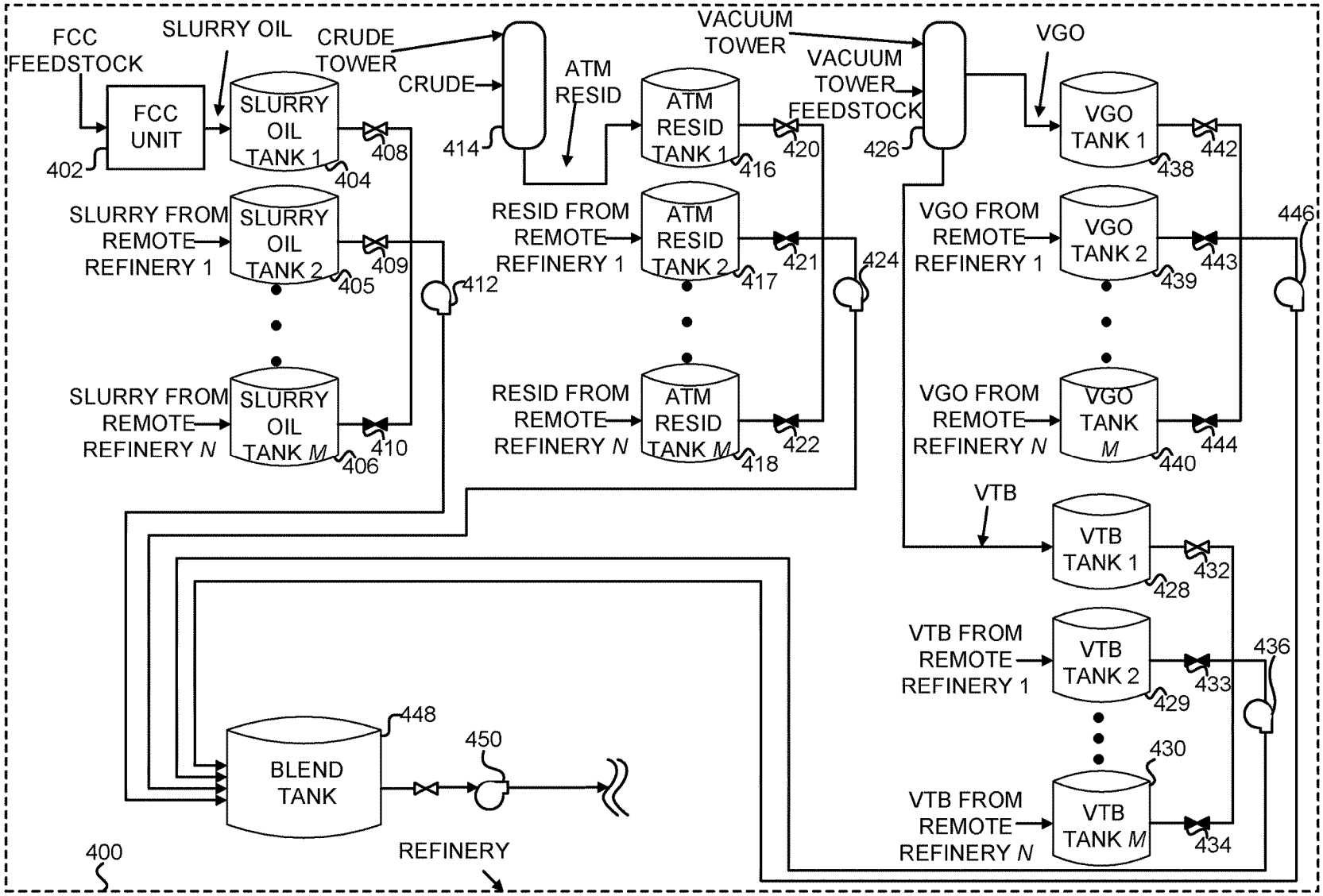
FIG. 4 is a schematic diagram of a refinery that produces one or more resids, one or more slurry oils, and one or more distillates (e.g. sweet gas oils, diesel fuel, jet fuel, kerosene, etc.) and stores one or more resids, one or more slurry oils, and one or more distillates acquired from outside the refinery for blending to create a low sulfur fuel oil for marine applications, according to one or more embodiments disclosed herein.

FIG. 4 is a schematic diagram of a refinery 400 that produces one or more resids, one or more slurry oils, and one or more distillates (e.g. vacuum gas oils) and stores one or more resids, one or more slurry oils, and one or more distillates acquired from outside the refinery for blending to create a low sulfur fuel oil for marine applications, according to one or more embodiments disclosed herein. As described above, various components may be mixed at various times and in varying order based on the different characteristics. For example, various slurry oils from the refinery 400 and/or remote refinery may be mixed in the blend tank 448, then a resid (e.g., ATB or VTB) may be added and mixed in the blend tank 448, and then vacuum gas oils (VGO) or other distillates/cutter stocks may be added and mixed in the blend tank 448. The slurry oils may be mixed first to achieve a mixture of an aromatic content by weight percentage close to that of the resid to be mixed. Further, the distillates (e.g., VGO) may be added to further alter the characteristics of the mixture or blend (e.g., sulfur content or overall weight).

For example, one or more slurry oils may be selected for a blending operation or process. In such examples, the slurry oils may be provided from within the refinery 400 or from a remote refinery. For example, a fluid catalytic cracker (FCC) 402 may produce slurry oil to be stored and/or used in the blending operation or process (e.g., stored in slurry oil tank 1 404). Other slurry oils produced at the refinery 400 may be stored in other slurry oil tanks. In another example, slurry oil may be transported from remote refineries for use in the blending operations or processes (e.g., stored in slurry oil tank 2 405 and/or up to slurry oil tank M 406). Each slurry oil tank (e.g., slurry oil tank 1 404, slurry oil tank 2 405, and/or up to slurry oil tank M 406) may be in fluid communication with a valve (e.g., valve 408, valve 409, and/or up to valve 410) to, when opened, allow for pumping, via pump 412, to the blend tank 448.

Similarly, one or more resids may be selected for the blending operation or process. In such examples, the atmospheric resid may be produced at a crude tower 414 within the refinery 400 and/or be produced at a remote refinery. The atmospheric resid may be stored in one or more resid tanks (e.g., atmospheric resid tank 1 416, atmospheric resid tank 2 417, and/or up to atmospheric resid tank M 418). A resid tank (e.g., atmospheric resid tank 1 416, atmospheric resid tank 2 417, and/or up to atmospheric resid tank M 418) may be in fluid communication with a corresponding valve (e.g., valve 420, valve 421, and/or up to valve 422) to, when opened, allow for pumping, via pump 424, of the selected one or more resid to the blend tank 448. Similarly, the vacuum resid from a vacuum tower may be stored in one or more resid tanks (e.g., VTB tank 1 428, VTB tank 2 429, and/or up to VTB tank M 430). As shown in FIG. 4, the VTB may also be provided by an external or remote refinery. A VTB tank (e.g., VTB tank 1 428, VTB tank 2 429, and/or up to VTB tank M 430) may be in fluid communication with a corresponding valve (e.g., valve 432, valve 433, and/or up to valve 434) to, when opened, allow for pumping, via pump 436, of the selected one or more VTB to the blend tank 448.

Similarly, one or more distillates may be selected for the blending operation or process. In such examples, the distillates may include a VGO from a vacuum tower 426 or another distillate, e.g., diesel fuel, jet fuel, kerosene, etc., from the atmospheric tower or elsewhere within the refinery 400. In another example, the VGO and/or other distillate may be provided by an external or remote refinery. The VGO may be stored in one or more VGO tanks (e.g., VGO tank 1 438, VGO tank 2 439, and/or up to VGO tank M 440). A VGO tank (e.g., VGO tank 1 438, VGO tank 2 439, and/or up to VGO tank M 440) may be in fluid communication with a corresponding valve (e.g., valve 442, valve 443, and/or up to valve 444) to, when opened, allow for pumping, via pump 446, of the selected one or more VGO to the blend tank 448. While described herein as VGO tanks, those skilled in the art will readily recognize that any distillate may be pumped into, stored and pumped out such tanks.

The mixture or blend produced at the blend tank 448 may be transported via pipeline and pump 450 to another tank, a vehicle for shipment, or to another location or terminal external to refinery 400. The refinery 400 may include one or more controllers (similar to the terminal of FIG. 3). The one or more controllers may allow for control and monitoring of the various processes and components within the refinery 400, particularly the blending or mixing operation or process, the cracking or FCC process, the process related to the crude tower 414, the process related to the vacuum tower 426, the opening and closing of valves disposed throughout the refinery 400, the pumps disposed throughout the refinery 400, and/or each tank storing the various liquids or components within the refinery 400.

Figure 5:
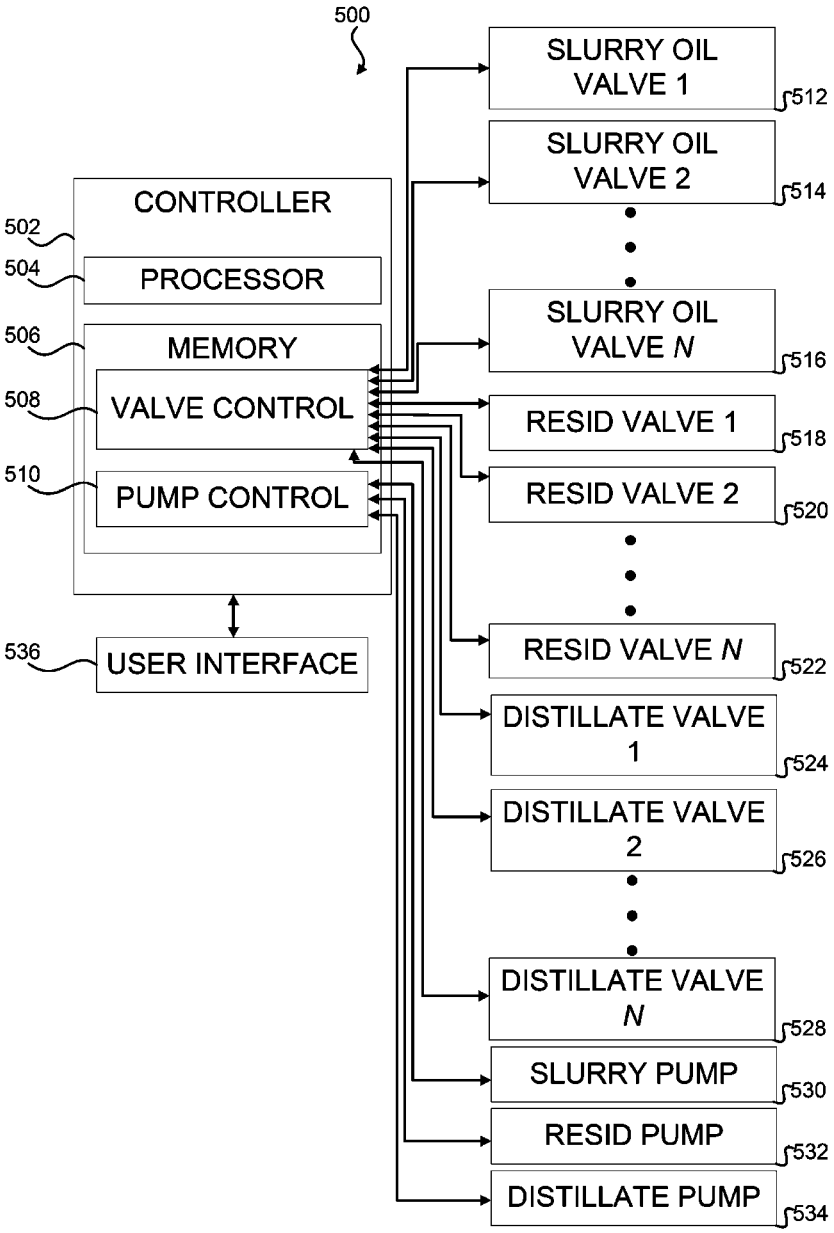
FIG. 5 is a simplified diagram illustrating a control system for managing the blending of components to create a low sulfur fuel oil for marine applications, according to one or more embodiments disclosed herein.

FIG. 5 is a simplified diagram illustrating a control system 500 for managing the blending of components to create a low sulfur fuel oil for marine applications, according to one or more embodiments disclosed herein. In an example, the control system may include a controller 502 or one or more controllers. Further the controller 502 may be in signal communication with various other controllers throughout or external to a refinery or terminal. The controller may be considered a supervisory controller. In another example, a supervisory controller may include the functionality of controller 502.

Each controller described above and herein may include a machine-readable storage medium (e.g., memory 506) and one or more processors (e.g., processor 504). As used herein, a "machine-readable storage medium" may be any electronic, magnetic, optical, or other physical storage apparatus to contain or store information such as executable instructions, data, and the like. For example, any machine-readable storage medium described herein may be any of random access memory (RAM), volatile memory, non-volatile memory, flash memory, a storage drive (e.g., hard drive), a solid state drive, any type of storage disc, and the like, or a combination thereof. The memory 506 may store or include instructions executable by the processor 504. As used herein, a "processor" may include, for example one processor or multiple processors included in a single device or distributed across multiple computing devices. The processor 504 may be at least one of a central processing unit (CPU), a semiconductor-based microprocessor, a graphics processing unit (GPU), a field-programmable gate array (FPGA) to retrieve and execute instructions, a real time processor (RTP), other electronic circuitry suitable for the retrieval and execution instructions stored on a machine-readable storage medium, or a combination thereof.

As used herein, "signal communication" refers to electric communication such as hard wiring two components together or wireless communication, as understood by those skilled in the art. For example, wireless communication may be Wi-Fi®, Bluetooth®, ZigBee, or forms of near field communications. In addition, signal communication may include one or more intermediate controllers or relays disposed between elements that are in signal communication with one another.

The controller 502 may include instructions 508 to control valves disposed throughout the refinery or terminal. In such examples, the controller 502 may determine when to open and close different valves. For example, if two particular slurry oils are selected, when those slurry oils are to be mixed, the controller 502 may open the corresponding valves. The controller 502 may be in signal communication with those valves (e.g., slurry oil valve 1 512, slurry oil valve 2 514, up to slurry oil valve N 516, resid valve 1 518, resid valve 2 520, up to resid valve N 522, distillate valve 1 524, distillate valve 2 526, and up to distillate valve N 528). In another example, the controller 502 may control whether each valve is open or closed. In yet another example, the controller 502 may control the degree or percentage that each valve is open. The controller 502 may also control the length of time to keep each valve open. In other words, the controller 502 may close a particular valve after a sufficient amount of the corresponding component has been added to the blend tank.

The controller 502 may also include instructions to control each of the pumps disposed throughout the refinery or terminal (e.g., slurry pump 530, resid pump 532, and/or distillate pump 534). The controller 502 may determine whether a pump should be activated based on a corresponding valve to be opened. In another example, each or some of the pumps may be a variable speed or variable frequency drive pump. In such examples, the controller 502 may determine the speed or frequency of the pump and set the pump at that speed or frequency based on the corresponding liquid (e.g., based on the viscosity of the liquid).

The controller 502 may also be in signal communication with a user interface 536. The user interface 536 may display information regarding a blending operation or process, as well as data related to each of the valves and pumps located at a refinery or terminal. In another example, a user may enter at the user interface data or an initiation to start the blending operation or process. In another example, a user may enter in various selections (e.g., different slurry oils, resids, and/or distillate) at the user interface 536 and, based on such selections, the controller 502 may open and close corresponding valves and activate pumps at the proper time to ensure the selected liquids are pumped to and mixed in a blend tank at the correct time and for a correct length of time. Further, the controller 502 may transmit or send prompts or other information to the user interface 536

Figure 6:
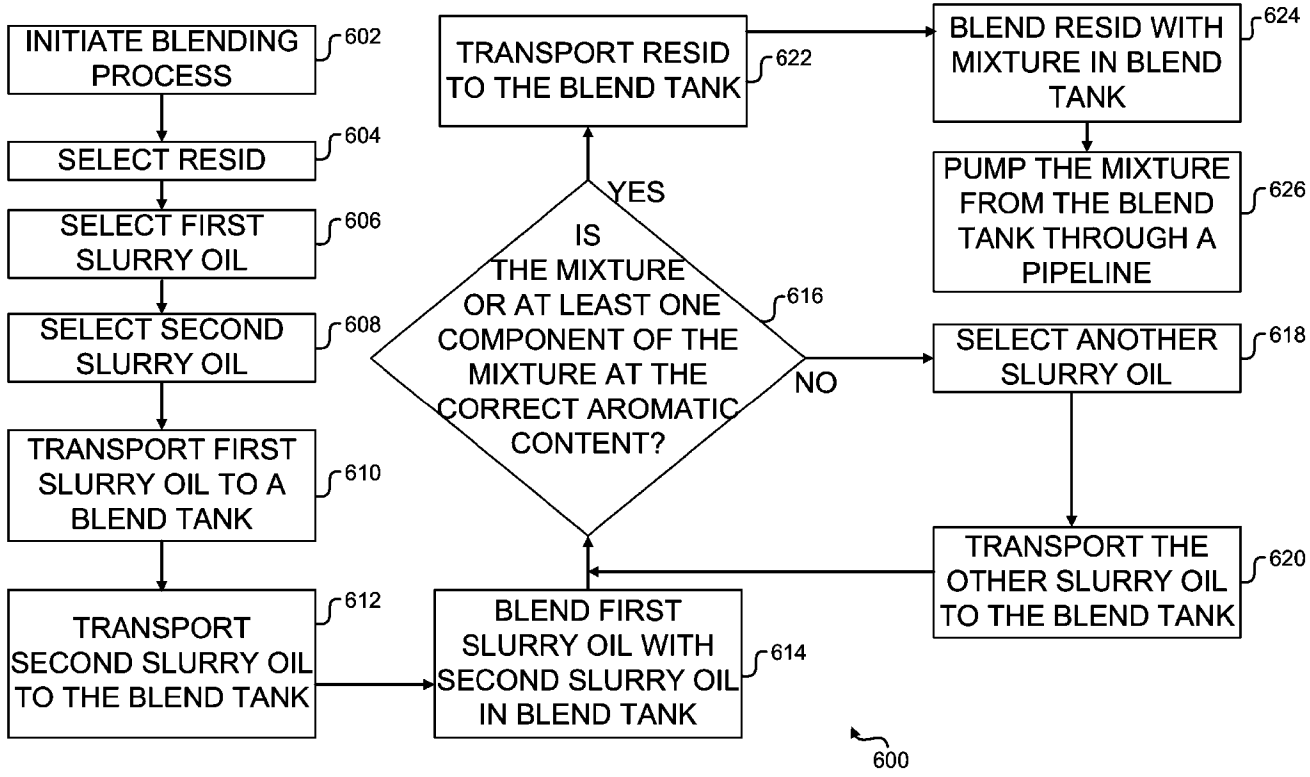
FIG. 6 is a flow diagram, implemented by a controller, for managing the blending of components to create a low sulfur fuel oil for marine applications, according to one or more embodiments disclosed herein.

FIG. 6 is a flow diagram, implemented by a controller, for managing the blending of components to create a low sulfur fuel oil for marine applications, according to one or more embodiments disclosed herein. The method 600 is detailed with reference to the terminal 200 of FIGS. 2 and 3. Unless otherwise specified, the actions of method 600 may be completed within the controller 302. Specifically, method 600 may be included in one or more programs, protocols, or instructions loaded into the memory of the controller 302 and executed on the processor or one or more processors of the controller 302. The order in which the operations are described is not intended to be construed as a limitation, and any number of the described blocks may be combined in any order and/or in parallel to implement the methods.

At block 602, the blending operation or process may be initiated. In an example, a user and/or the controller 302 may initiate the blending operation or process. In such examples, a user may initiate the blending operation or process via a user interface in signal communication with the controller 302. In another example, a controller 302 may initiate the blending operation or process when selected components are available.

At block 604, a user or controller 302 may select one or more resids from available resids at the terminal 200 or refinery, based on resids currently stored at the terminal 200 or refinery (e.g., from resid tank 1 208, resid tank 2 209, and/or up to resid tank N 210). In an example the resid may include an aromatic content of less than about 50%.

At block 606 and 608, the user or controller 302 may select a first slurry oil and a second slurry oil, respectively, from available slurry oils at the terminal 200 or refinery, based on slurry oils stored at the terminal 200 or refinery (e.g., from slurry oil tank 1 202, slurry oil tank 2 203, and/or up to slurry oil tank N 204). In an example, the first slurry oil may include a high aromatic content (e.g., 70% to 80% or higher per weight). In another example, the second slurry oil may include an aromatic content slightly lower than the first slurry oil (e.g., within about 5%, within about 10%, within about 15%, or even within about 20%). In another example, the second slurry oil may include an aromatic content at a lower aromatic content (e.g., less than 70% by weight). In another example, other slurry oils, resids, or distillates may be selected for the blending operation or process before or after the actual blending or mixing occurs.

At block 612, the first selected slurry oil and second selected slurry oil may be transported to the blend tank 220 (e.g., via corresponding valves, pipeline, and/or pumps). At block 614, the blend tank may blend the first selected slurry oil and second selected slurry for a specified period or interval of time. In another example, rather than checking the aromatic content at this point, the further selected slurry oils, resids, and/or distillates may be mixed, in the proper sequence (e.g., but not to be limiting, in the order of slurries, resids and distillates), and pumped and transported from the blend tank 220.

In another example, at block 614, the controller 302 or a user may check the aromatic content (i.e., the percentage of aromatics therein) of the current mixture in the blend tank 220 and verify that the aromatic content is close to that of the selected resid (e.g., within 1% to 20%, within 12% to 18%, within 14% to 16%, etc.). In another example, the controller 302 may verify that at least one component currently in the mixture is close to the aromatic content of the selected resid (e.g., within 1% to 20%, within 12% to 18%, within 14% to 16%, etc.). In either example, if the aromatic content is not near that of the selected resid, the controller 302 or a user may select another slurry oil, at block 618, which may then be transported, at block 620, to the blend tank 220.

Once the aromatic content (i.e., the percentage of aromatics) in the mixture is near that of the selected resid, at block 622, the resid may be transported to the blend tank 220. At block 624, the resid may be mixed with the current mixture at the blend tank 624. In another example, the current characteristics of the blend or mixture may be determined and compared to a specification of a target low sulfur fuel or marine fuel. In such examples, if the specifications are not met (e.g., sulfur content is too high or weight is too high), a low sulfur distillate and/or a heavy distillate may be selected and transported to the blend tank for mixing with the current mixture or blend at the blend tank 220. At block 626, the final blend or mixture may be pumped from the blend tank 220, via a pump 222, to an end user.

As is known to those skilled in the art, resid or residuum is any refinery fraction left behind after distillation. Resid may refer to atmospheric tower bottoms and/or vacuum tower bottoms.

Atmospheric tower bottoms (ATB), also called long resid, is the heaviest undistilled fraction (uncracked) in the atmospheric pressure distillation of a crude oil, as is known to those skilled in the art. ATB has crude oil components with boiling points above about 650° F. (343° C.), which is below the cracking temperature of the crude oil.

Vacuum tower bottoms (VTB), also called short resid, is the heaviest undistilled fraction (uncracked) in the vacuum distillation of a hydrocarbon feedstock, as is known to those skilled in the art. VTBs may have one or more of the following characteristics: a density at 15° C. of between about 0.8 and about 1.1 g/ml, a sulfur content of between about 1.0 and about 3.0 wt %, a pour point of between about −20 and about 75° C., a kinematic viscosity of between about 50 and about 12,000 cSt (50° C.), a flash point of between about 50 and about 200° C., and an API density of between about 3.0 and about 20. Moreover, VTBs generated from sweet run hydrocarbon feedstock (e.g., hydrotreated feedstock to the vacuum tower) may have sulfur content below about 1.0 wt %, below about 0.9 wt %, below about 0.8 wt %, below about 0.7 wt %, below about 0.6 wt %, below about 0.5 wt %, below about 0.4 wt %, below about 0.3 wt % or even below about 0.2 wt %. Decant oil (DCO), also known as slurry oil, is a high-boiling catalytic cracked aromatic process oil and is the heaviest cut off of a fluid catalytic cracker unit, as is known to those skilled in the art. Decant oil may have one or more of the following characteristics: a density at 15° C. of between about 0.9 and about 1.2 g/ml, a sulfur content of between about 0.20 and about 0.50 wt %, a pour point of between about −5 to about 5° C., a kinematic viscosity of between about 100 and about 200 cSt (50° C.), a flash point between about 50 and about 150° C., and an API of between about −1.0 and about 1.0.

Vacuum gas oil (VGO) may be light and/or heavy gas oil cuts from the vacuum distillation column, as is known to those skilled in the art. VGO may have one or more of the following characteristics: a density at 15° C. of between about 0.85 and about 1.1 g/ml, a sulfur content of between about 0.02 and about 0.15 wt %, a pour point of between about to 15 about 35° C., a kinematic viscosity of between about 15 and about 35 cSt (50° C.), a flash point between about 100 and about 175° C., and an API of between about 15 and about 30.

Cycle oil is the diesel-range, cracked product from the fluid catalytic cracker unit, as is known to those skilled in the art. Cycle oil may be light, medium or heavy and may have one or more of the following characteristics: a density at 15° C. of between about 0.75 and about 1.0 g/ml, a sulfur content of between about 0.01 and about 0.25 wt %, a kinematic viscosity of between about 2 and about 50 cSt (50° C.), a flash point between about 50 and about 70° C., and an API of between about 25 and about 50.

The ISO 8217, Category ISO-F RMG 380 specifications for residual marine fuels are given below in TABLE XIII. As used in this disclosure, achieving or meeting the IMO 2020 specifications per ISO 8217 for a particular fuel oil blend is with respect to the values for the blend characteristics as listed in Table XIII below and as confirmed by the respective test methods and/or references provided in ISO 8217. As understood by those skilled in the art, the other specifications provided in ISO 8217, e.g., RMA, RMB, RMD, RME, and RMK, may sought to be achieved by adjusting the blend compositions.

TABLE XIII

| Characteristics | Unit | Limit | Category ISO-F RMG 380 | Test Method(s) and References |
|---|---|---|---|---|
| Kinematic Viscosity @ 50° C. | cSt | Max | 380.0 | ISO 3104 |
| Density @ 15° C. | $kg/m^3$ | Max | 991.0 | ISO 3675 or ISO 12185 |
| CCAI | | Max | 870 | Calculation |
| Sulfur | mass % | Max | 0.5 | ISO 8754 or ISO 14595 or ASTM 04294 |
| Flash Point | ° C. | Min | 60.0 | ISO 2719 |
| Hydrogen Sulfide | mg/kg | Max | 2.00 | IP 570 |
| Acid Number | mgKOH/g | Max | 2.5 | ASTM D564 |
| Total Sediment—Aged | mass % | Max | 0.10 | ISO 10307-2 |
| Carbon Residue—Micro Method | mass % | Max | 18.00 | ISO 10370 |
| Pour Point (upper) Winter | ° C. | Max | 30 | ISO 3016 |
| Summer | ° C. | Max | 30 | |
| Water | vol % | Max | 0.50 | ISO 3733 |
| Ash | mass % | Max | 0.100 | ISO 6245 |
| Vanadium | mg/kg | Max | 350 | IP 501, IP 470 or iSO 14597 |
| Sodium | mg/kg | Max | 100 | IP 501, IP 470 |
| Al + Si | mg/kg | Max | 60 | IP 501, IP 470 or ISO 10478 |
| Used Lubricating Oil (ULO): Ca and Z or Ca and P | mg/kg | Max | Ca > 30 and Z > 15 or CA > 30 and P > 15 | IP 501 or IP470, IP 500 |

In the drawings and specification, several embodiments of low sulfur fuel oil blend compositions and methods of making such blend compositions are disclosed that increase stability and compatibility of paraffinic resids that are blended with slurry oils having higher asphaltene and/or aromatic contents. Although specific terms are employed, the terms are used in a descriptive sense only and not for purposes of limitation. Embodiments of systems and methods have been described in considerable detail with specific reference to the illustrated embodiments. However, it will be apparent that various modifications and changes to disclosed features can be made within the spirit and scope of the embodiments of systems and methods as may be described in the foregoing specification, and features interchanged between disclosed embodiments. Such modifications and changes are to be considered equivalents and part of this disclosure.

What is claimed is:

1. A method of making and distributing a low sulfur marine bunker fuel oil composition that has an increased initial compatibility and longer term stability, the method comprising:

selecting a resid having an aromatic content of less than about 50% by weight, selecting a first slurry oil having an aromatic content of greater than about 70% by weight;

selecting a second slurry oil having an aromatic content of less than about 70% by weight;

adding the first slurry oil to a tank;

adding the second slurry oil to the tank;

blending the first slurry oil and the second slurry oil together in a tank to define a slurry oil mixture, the slurry oil mixture having a percentage of aromatics less than the aromatic content of the first slurry oil;

adding the resid into the tank with the slurry oil mixture;

blending the resid with the slurry oil mixture to define a low sulfur marine bunker fuel oil, the low sulfur marine bunker fuel oil having a sulfur content less than about 0.5% by weight and an aged sediment of less than about 0.1% by weight; and pumping the low sulfur marine bunker fuel oil from the tank through a pipeline.

2. The method of claim 1, wherein the resid is one or more of a vacuum tower bottoms resid or an atmospheric tower bottoms resid.

3. The method of claim 1, further comprising:

acquiring an additional slurry oil having an aromatic content by weight percent less than the aromatic content of the second slurry oil, blending the additional slurry oil into the slurry oil mixture in the tank, and maintaining the percentage of aromatics in the slurry oil mixture less than the aromatic content of the first slurry oil prior to blending the resid therewith.

4. The method of claim 1, further comprising adding a distillate that has a sulfur content less than about 0.5% by weight into the tank.

5. The method of claim 1, further comprising obtaining one or more of the resid, the first slurry oil or the second slurry oil from an off-site refinery.

6. A low sulfur marine bunker fuel oil composition that has an increased initial compatibility and longer term stability, the composition comprising:

a first slurry oil having an aromatic content of greater than about 70% by weight;

a second slurry oil having an aromatic content of less than about 70% by weight, the second slurry oil and the first slurry oil being blended to define a slurry oil mixture; and a resid having a paraffinic content of at least 35% by weight and an aromatic content of less than about 50% by weight, the resid being added to the slurry oil mixture to define a low sulfur marine bunker fuel oil, the low sulfur marine bunker fuel oil having a sulfur content less than about 0.5% by weight and an aged sediment of less than about 0.1% by weight.

7. The composition of claim 6, wherein the resid is one or more of a vacuum tower bottoms resid or an atmospheric tower bottoms resid.

8. The composition of claim 6, further comprising a distillate that has a sulfur content less than about 0.5% by weight.

9. A method of making and distributing a low sulfur marine bunker fuel oil composition that has an increased initial compatibility and longer term stability, the method comprising:

selecting a resid having a paraffinic content of at least 35% by weight;

selecting a first slurry oil having an aromatic content of greater than about 65% by weight;

selecting a second slurry oil having an aromatic content that is between about 1% and about 20% by weight lower than the aromatic content of the first slurry;

adding the first slurry oil to a tank;

adding the second slurry oil to the tank;

blending the first slurry oil and the second slurry oil together in a tank to define a slurry oil mixture, the slurry oil mixture having a percentage of aromatics less than the aromatic content of the first slurry oil;

adding the resid into the tank with the slurry oil mixture;

blending the resid with the slurry oil mixture to define a low sulfur marine bunker fuel oil, the low sulfur marine bunker fuel oil having a sulfur content less than about 0.5% by weight and an aged sediment of less than about 0.1% by weight; and pumping the low sulfur marine bunker fuel oil from the tank through a pipeline.

10. The method of claim 9, wherein the resid is one or more of a vacuum tower bottoms resid or an atmospheric tower bottoms.

11. The method of claim 9, further comprising:

acquiring an additional slurry oil having an aromatic content by weight percent less than the aromatic content of the second slurry, blending the additional slurry oil into the slurry oil mixture in the tank, and maintaining the percentage of aromatics in the slurry oil mixture less than the aromatic content of the first slurry oil prior to blending the resid therewith.

12. The method of claim 9, wherein the second slurry oil has an aromatic content that is between about 12% and about 18% by weight lower than the aromatic content of the first slurry.

13. The method of claim 9, wherein the second slurry oil has an aromatic content that is between 14% and about 16% by weight lower than the aromatic content of the first slurry.

14. The method of claim 9, further comprising obtaining one or more of the resid, the first slurry oil or the second slurry oil from an off-site refinery.

15. The method of claim 9, further comprising adding a distillate that has a sulfur content less than about 0.5% by weight into the tank.

16. The method of claim 15, wherein the distillate added constitutes no more than about 10% by weight of the low sulfur marine bunker fuel oil.

17. The method of claim 15, wherein the distillate added constitutes no more than about 5% by weight of the low sulfur marine bunker fuel oil.

18. The method of claim 9, further comprising adding a distillate that has a sulfur content less than about 0.5% by weight to the tank after adding a last slurry oil and before adding the resid.

19. The method of claim 9, wherein the low sulfur marine bunker fuel oil has no added distillate.

20. The method of claim 9, wherein the second slurry oil has an aromatic content by weight percent within about 1% to about 20% by weight of an aromatic content of the resid.

* * * * *